US010795305B1

(12) United States Patent
Kuribayashi et al.

(10) Patent No.: US 10,795,305 B1
(45) Date of Patent: Oct. 6, 2020

(54) IMAGE FORMING APPARATUS AND PROCESS CARTRIDGE

(71) Applicant: FUJI XEROX CO., LTD., Tokyo (JP)

(72) Inventors: Masataka Kuribayashi, Kanagawa (JP); Makoto Kamisaki, Kanagawa (JP); Jun Sekiya, Kanagawa (JP); Shota Oshima, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/546,858

(22) Filed: Aug. 21, 2019

(30) Foreign Application Priority Data

Mar. 13, 2019 (JP) ..... 2019-046329

(51) Int. Cl.
*G03G 21/00* (2006.01)
*G03G 15/00* (2006.01)
*G03G 21/16* (2006.01)

(52) U.S. Cl.
CPC ..... *G03G 21/0011* (2013.01); *G03G 15/6585* (2013.01); *G03G 21/169* (2013.01); *G03G 2221/1627* (2013.01)

(58) Field of Classification Search
CPC ..... G03G 21/0011; G03G 21/169; G03G 15/6585; G03G 2221/1627
See application file for complete search history.

(56) References Cited

U.S. PATENT DOCUMENTS 6,040,104 A 3/2000 Nakamura et al.
7,291,436 B2 * 11/2007 Nakamura ..... G03G 9/0821 430/110.2

(Continued)

FOREIGN PATENT DOCUMENTS

JP 11-194542 A 7/1999
JP 2007-212979 A 8/2007
JP 2011-081052 A 4/2011

*Primary Examiner* — Clayton E. LaBalle
*Assistant Examiner* — Michael A Harrison
(74) *Attorney, Agent, or Firm* — Sughrue Mion, PLLC

(57) ABSTRACT

An image forming apparatus includes an image carrier; a charging section that charges a surface of the image carrier; an electrostatic charge image forming section that forms an electrostatic charge image on the charged surface of the image carrier; a developing section that has a container containing an electrostatic charge image developer and develops the electrostatic charge image formed on the surface of the image carrier into a toner image using the electrostatic charge image developer, the electrostatic charge image developer including toner for electrostatic charge image development, the toner containing toner particles and an external additive; a transfer section that transfers the toner image formed on the surface of the image carrier to a surface of a recording medium; a cleaning section that has a cleaning blade with which the cleaning section cleans the surface of the image carrier; and a lubricant supplying section that has a lubricant supplying member that supplies a lubricant to the contact portion between the cleaning blade and the image carrier. The toner satisfies the following relations: $(\ln \eta(T1)-\ln \eta(T2))/(T1-T2) \leq -0.14$; $(\ln \eta(T2)-\ln \eta(T3))/(T2-T3) \geq -0.15$; and $(\ln \eta(T1)-\ln \eta(T2))/(T1-T2) < (\ln \eta(T2)-\ln \eta(T3))/(T2-T3)$, where $\eta(T1)$ represents a viscosity of the toner at 60° C., $\eta(T2)$ represents a viscosity of the toner at 90° C., and $\eta(T3)$ represents a viscosity of the toner at 130° C.

14 Claims, 3 Drawing Sheets

(56) References Cited

U.S. PATENT DOCUMENTS

| | | | | |
|---|---|---|---|---|
| 8,811,881 | B2 | 8/2014 | Nishida | |
| 2009/0290919 | A1 * | 11/2009 | Tanaka | G03G 21/0094 399/346 |

* cited by examiner

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2019-046329 filed Mar. 13, 2019.

BACKGROUND

(i) Technical Field

The present disclosure relates to an image forming apparatus and a process cartridge.

(ii) Related Art

Electrophotographic image formation is performed by, for example, charging the surface of an image carrier, forming an electrostatic charge image on the charged surface of the image carrier in accordance with image information, developing the electrostatic charge image using a developer that includes toner for developing the electrostatic charge image to form a toner image for developing the electrostatic charge image, and transferring the toner image to the surface of a recording medium and fixing the toner image there.

Japanese Laid Open Patent Application Publication No. 11-194542 discloses an electrophotographic toner for developing an electrostatic charge image. The electrophotographic toner includes a binder resin and a coloring agent, and the binder resin has its minimum tan δ at a temperature between its glass transition temperature (Tg) and the temperature at which its loss modulus (G')=$1\times10^4$ Pa. The minimum tan δ is less than 1.2, and at the temperature at which the tan δ is at its minimum, the resin has a storage modulus (G')=$5\times10^5$ Pa or more. At the temperature at which G'=$1\times10^4$ Pa, the tan δ is 3.0 or more.

Japanese Laid Open Patent Application Publication No. 2007-212979 discloses a cleaning device that is part of an image forming apparatus and applies a lubricant to an image carrier to which a particulate developer adheres. The cleaning device includes a lubricant-holding member, at least one roller-shaped brush member, and flicker members. The lubricant-holding member holds a solid lubricant. The roller-shaped brush member is driven to rotate, scraping the lubricant off the lubricant-holding member and applying the scraped lubricant to the surface of the image carrier. The flicker members are in contact with the brush member and remove any developer adhering to the brush member. The cleaning device has multiple flicker members for one brush member.

A known type of image forming apparatus has an image carrier, a charging section, a section for forming an electrostatic charge image, a developing section, a transfer section, a section for supplying a lubricant, and a cleaning section. The developing section contains a developer for an electrostatic charge image and develops the electrostatic charge image formed on the surface of the image carrier into a toner image for developing an electrostatic charge image using the developer for an electrostatic charge image. The developer for an electrostatic charge image includes toner, and the toner contains toner particles and external additive(s). (This type of image forming apparatus may hereinafter be referred to as a "specific image forming apparatus.)

Specific image forming apparatuses of the related art can suffer streak-shaped image defects. Another disadvantage of specific image forming apparatuses of the related art is the phenomenon in which the image carrier loses its surface resistance and, as a result, becomes unable to hold a latent image firmly thereon (hereinafter also referred to as "image deletion").

SUMMARY

Aspects of non-limiting embodiments of the present disclosure relate to an image forming apparatus that reduces both streak-shaped image defects and image deletion in comparison with specific image forming apparatuses in which the toner in the developer for an electrostatic charge image has a (ln η(T1)−ln η(T2))/(T1−T2), described hereinafter, exceeding −0.14 or in which the toner in the developer has a (ln η(T2)−ln η(T3))/(T2−T3), described hereinafter, of less than −0.15.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: an image carrier; a charging section that charges the surface of the image carrier; an electrostatic charge image forming section that forms an electrostatic charge image on the charged surface of the image carrier; a developing section that has a container containing an electrostatic charge image developer and develops the electrostatic charge image formed on the surface of the image carrier into a toner image using the electrostatic charge image developer, the electrostatic charge image developer including toner for electrostatic charge image development, the toner containing toner particles and an external additive; a transfer section that transfers the toner image formed on the surface of the image carrier to the surface of a recording medium; a cleaning section that has a cleaning blade with which the cleaning section cleans the surface of the image carrier; and a lubricant supplying section that has a lubricant supplying member that supplies a lubricant to the contact portion between the cleaning blade and the image carrier. The toner satisfies the following relations:

$$(\ln \eta(T1)-\ln \eta(T2))/(T1-T2)\leq-0.14;$$

$$(\ln \eta(T2)-\ln \eta(T3))/(T2-T3)\geq-0.15;\text{ and}$$

$$(\ln \eta(T1)-\ln \eta(T2))/(T1-T2)<(\ln \eta(T2)-\ln \eta(T3))/(T2-T3),$$

where η(T1) represents the viscosity of the toner at 60° C., η(T2) represents the viscosity of the toner at 90° C., and η(T3) represents the viscosity of the toner at 130° C.

BRIEF DESCRIPTION OF THE DRAWING

An exemplary embodiment of the present disclosure will be described in detail based on the following figures, wherein.

DETAILED DESCRIPTION

Figure 1:
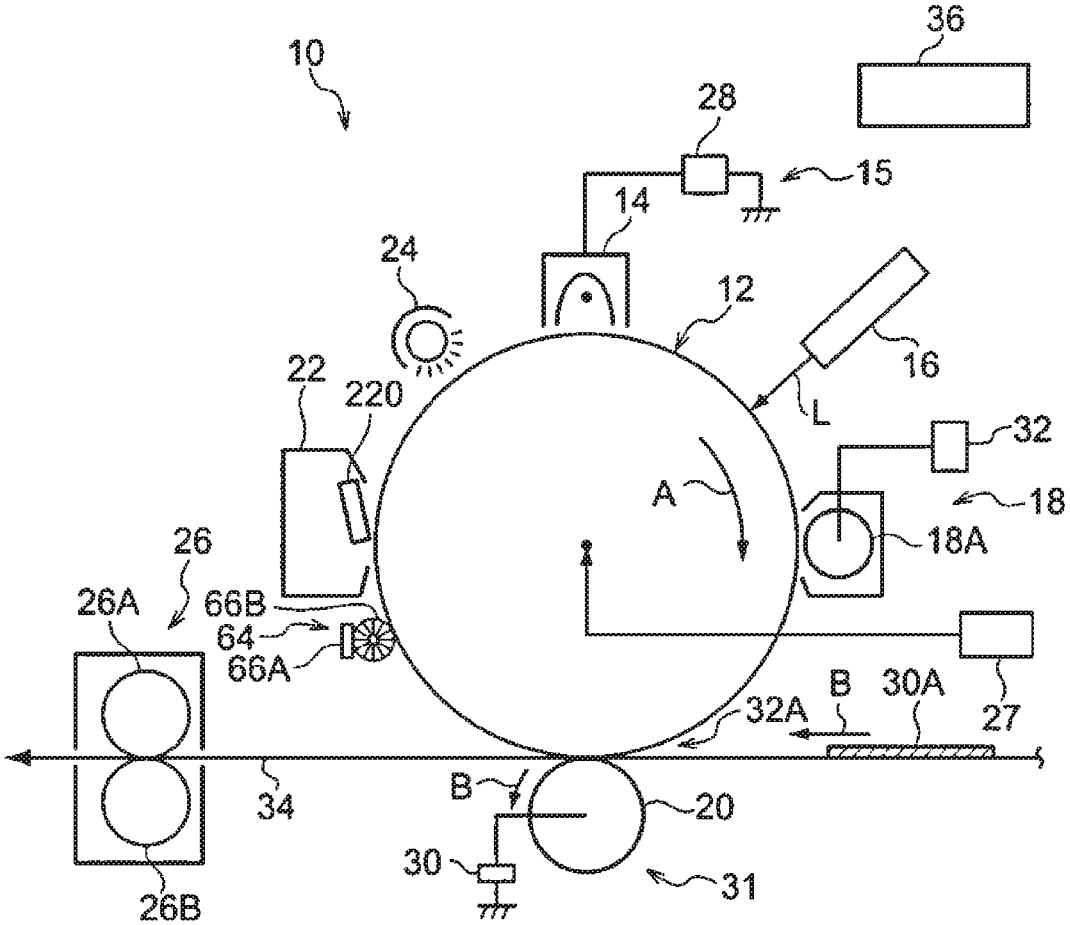
FIG. 1 schematically illustrates the structure of an example of an image forming apparatus according to this exemplary embodiment.

The following describes an exemplary embodiment of the present disclosure. The following description and Examples are intended to illustrate the exemplary embodiment and do not limit the scope of the exemplary embodiment.

The present disclosure mentions series of numerical ranges. The upper or lower limit of one of such numerical ranges may be substituted with the upper or lower limit of another numerical range in the same series. The upper or lower limit of a numerical range herein may be substituted with a value specified in Examples.

An ingredient herein may be a combination of multiple substances. If a composition described herein contains a combination of multiple substances as an ingredient, the amount of the ingredient represents the total amount of the substances in the composition unless stated otherwise.

Image Forming Apparatus

An image forming apparatus according to an exemplary embodiment includes an image carrier; a charging section that charges the surface of the image carrier; an electrostatic charge image forming section that forms an electrostatic charge image on the charged surface of the image carrier; a developing section that has a container containing an electrostatic charge image developer and develops the electrostatic charge image formed on the surface of the image carrier into a toner image using the electrostatic charge image developer, the electrostatic charge image developer including toner for electrostatic charge image development, the toner containing toner particles and an external additive; a transfer section that transfers the toner image for electrostatic charge image development formed on the surface of the image carrier to the surface of a recording medium; a cleaning section that has a cleaning blade with which the cleaning section cleans the surface of the image carrier; and a lubricant supplying section that has a lubricant supplying member that supplies a lubricant to the contact portion between the cleaning blade and the image carrier. An image forming apparatus having this structure may hereinafter be referred to as a "specific image forming apparatus."

The image forming apparatus according to this exemplary embodiment, moreover, contains an electrostatic charge image developer that includes toner for electrostatic charge image development. The toner has the following characteristics:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) represents the viscosity of the toner at 60° C., η(T2) represents the viscosity of the toner at 90° C., and η(T3) represents the viscosity of the toner at 130° C. A toner according to this exemplary embodiment for electrostatic charge image development having these characteristics may hereinafter be referred to simply as a "specific toner."

The following describes the characteristics of a specific toner used in this exemplary embodiment.

The formula (ln η(T1)−ln η(T2))/(T1−T2) is a measure of how much the viscosity of the toner changes at temperatures from 60° C. to 90° C., and a (ln η(T1)−ln η(T2))/(T1−T2) of −0.14 or less means that the toner greatly changes its viscosity at temperatures from 60° C. to 90° C. The formula (ln η(T2)−ln η(T3))/(T2−T3), on the other hand, is a measure of how much the viscosity of the toner changes at temperatures from 90° C. to 120° C., and a (ln η(T2)−ln η(T3))/(T2−T3) of −0.15 or more and greater than the (ln η(T1)−ln η(T2))/(T1−T2) means that the toner changes little its viscosity at temperatures from 90° C. to 120° C. The specific toner therefore changes its viscosity sharply at temperatures from 60° C. to 90° C. and little at temperatures from 90° C. to 120° C. In a toner that exhibits such a viscosity profile, the inventors believe, the binder resin contained in the toner particles has low-molecular-weight and high-molecular-weight components both in appropriate proportions. That is, a low-molecular-weight component in the binder resin promotes changes in viscosity at temperatures from 60° C. to 90° C., whereas a high-molecular-weight component in the binder resin limits changes in viscosity at high temperatures from 90° C. to 120° C.

Given such a viscosity profile, the specific toner changes little its viscosity and has moderate viscoelasticity at temperatures from room temperature (e.g., 20° C.) to 60° C. That is, the presence of appropriate proportions of low- and high-molecular-weight components in the binder resin ensures that the specific toner is stable in viscosity and maintains moderate viscoelasticity at temperatures of 60° C. or below. The specific toner, having the characteristics specified above, is therefore stable in viscosity and has moderate viscoelasticity at temperatures from room temperature to 60° C.

An electrophotographic image forming apparatus has a cleaning section that cleans the image carrier by contacting a cleaning blade on the surface of the image carrier. In this type of image forming apparatus, the toner used to develop an electrostatic charge image tends to form a layer of external additive(s), which is contained in the toner, immediately before the contact portion between the image carrier and the cleaning blade (hereinafter also referred to as "the blade nip") as a result of at least part of the external additive(s) released from toner particles aggregating there (hereinafter also referred to as a "dam of external additive(s)"). This dam of external additive(s) has two roles: to block toner particles from slipping through the blade nip, and to limit the deposition of discharge products, such as the ammonium ion, generated by the charging section.

Specific image forming apparatuses of the related art, however, occur streak-shaped image defects and the phenomenon in which the image carrier deteriorate its ability to hold a latent image firmly thereon (hereinafter also referred to as "image deletion") during repeated image formation. It is unclear what exactly causes them, but the inventors speculate as follows.

Possible Reason for the Streak-Shaped Image Defects

Specific image forming apparatuses of the related art have used the technology of forming a lubricant coating on the surface of the image carrier, for example for the purpose of reducing the friction between the cleaning blade and the surface of the image carrier. This is achieved using a lubricant supplying member, the member that supplies a lubricant to the surface of the image carrier. In this process of forming a lubricant coating, the residual toner left on the surface of the image carrier after transfer, or residual toner, may adhere to the lubricant supplying member. If this adhering residual toner is too high in viscoelasticity, the lubricant supplying member, when coming into contact with the lubricant to take it, tends to scrape much lubricant because of the hard residual toner adhering thereto, in comparison with the case in which no residual toner is adhering to the lubricant supplying member. The large amount of lubricant scraped on and adhering to the lubricant supplying member often forms a thick coating if supplied to the surface of the image carrier directly. This thick coating tends to interfere with the formation of the dam of external additive(s) at the blade nip by catching the external additive(s) released from the residual toner. This coating with external additive(s) adhering thereto, moreover, contacts with the cleaning blade on the surface of the image carrier, often causing the cleaning blade to wear. The worn cleaning blade allows toner particles to slip through the blade nip. The inventors believe this is the reason why repeated image formation using a specific image forming apparatus causes streak-shaped image defects that extend in the direction of transport of the recording medium.

A specific image forming apparatus according to this exemplary embodiment includes a toner that has the characteristics mentioned above. The toner according to this exemplary embodiment is therefore not too high in viscoelasticity, and with such a toner it tends to be unlikely that much lubricant is scraped because of residual toner. Accordingly, the specific image forming apparatus experiences little slipping of toner particles residue between the cleaning blade and the image carrier and is less prone to streak-shaped image defects.

Possible Reason for Image Deletion

If the aforementioned adhering residual toner has too low viscoelasticity, the soft residual toner adhere extensively to the lubricant supplying member when the lubricant supplying member contacts with the lubricant, in comparison with the case in which no residual toner is adhering to the lubricant supplying member. The extensive spread of residual toner prevents the lubricant supplying member from scraping the lubricant, often decreasing the supply of the lubricant to the surface of the image carrier. The lubricant coating on the surface of the image carrier may therefore be formed only sparsely, causing discharge products generated by the charging section, for example, to remain not on the lubricant coating, from which they can be removed easily by adsorption, but directly on the surface of the image carrier, from which they cannot be removed easily. The inventors believe these discharge products not removed but left there decrease the surface resistance of the image carrier, making the image carrier unable to hold a latent image firmly thereon and thereby causing image deletion.

A specific image forming apparatus according to this exemplary embodiment includes a toner that has the characteristics mentioned above. The toner according to this exemplary embodiment has therefore not too low viscoelasticity, and with such a toner it tends to be unlikely that residual toner adheres extensively to the lubricant supplying member. The supply of the lubricant from the lubricant supplying member to the surface of the image carrier is therefore sufficient for the discharge products to be removed by adsorption. As a result, the inventors believe, image deletion is reduced.

The inventors believe this is the way a specific image forming apparatus according to this exemplary embodiment reduces both streak-shaped image defects and image deletion.

The following describes the structure of an image forming apparatus according to this exemplary embodiment in detail.

An image forming apparatus according to this exemplary embodiment includes an image carrier; a charging section that charges the surface of the image carrier; an electrostatic charge image forming section that forms an electrostatic charge image on the charged surface of the image carrier; a developing section that has a container containing an electrostatic charge image developer and develops the electrostatic charge image formed on the surface of the image carrier into a toner image using the electrostatic charge image developer, the electrostatic charge image developer including toner for electrostatic charge image development, the toner containing toner particles and an external additive; a transfer section that transfers the toner image for electrostatic charge image development formed on the surface of the image carrier to the surface of a recording medium; a cleaning section that has a cleaning blade with which the cleaning section cleans the surface of the image carrier; and a lubricant supplying section that has a lubricant supplying member that supplies a lubricant to the contact portion between the cleaning blade and the image carrier.

The scope of application of an image forming apparatus according to this exemplary embodiment includes known types of image forming apparatuses, such as direct-transfer apparatuses, which operate by forming a toner image for the development of an electrostatic charge image on the surface of an image carrier and transferring it directly to a recording medium; intermediate-transfer apparatuses, which operate by forming a toner image for the development of an electrostatic charge image on the surface of an image carrier, transferring it to the surface of an intermediate transfer body (first transfer), and then transferring the toner image for the development of an electrostatic charge image on the surface of the intermediate transfer body to the surface of a recording medium (second transfer); and apparatuses that include a static eliminator, a device that removes static electricity from the surface of the image carrier by irradiation with antistatic light between the transfer of a toner image for electrostatic charge image development and charging.

If the apparatus is of intermediate-transfer type, the transfer device has, for example, an intermediate transfer body, a first-transfer device, and a second-transfer device. A toner image for electrostatic charge image development formed on the surface of the image carrier is transferred by the first-transfer device to the surface of the intermediate transfer body (first transfer). The toner image for electrostatic charge image development, now on the surface of the intermediate transfer body, is then transferred by the second-transfer device to the surface of a recording medium (second transfer).

Part of an image forming apparatus according to this exemplary embodiment, for example a portion including the image carrier, may have a cartridge structure, a structure that allows the part to be attached to and detached from the image forming apparatus (i.e., may be a process cartridge).

The following describes an example of an image forming apparatus according to this exemplary embodiment. It should be noted that this is not the only example. The following description is focused on the structural elements illustrated in the drawings.

FIG. 1 schematically illustrates the structure of an example of an image forming apparatus according to this exemplary embodiment.

An image forming apparatus 10 according to this exemplary embodiment includes, for example, an image carrier 12 as illustrated in FIG. 1. The image carrier 12 is cylindrical and is coupled to a driver 27, such as a motor, by a transmitter of driving force (not illustrated), such as gears. The driver 27 rotates the image carrier 12 around the axis indicated by a black dot. In FIG. 1, the image carrier 12 is rotated in the direction of arrow A.

Around the image carrier 12 are, for example, a charging device 15 (example of a charging section), an electrostatic charge image forming device 16 (example of an electrostatic charge image forming section), a developing device 18 (example of a developing section), a transfer device 31 (example of a transfer section), a lubricant supplying device 64 (example of a lubricant supplying section), a cleaning device 22 (example of a cleaning section), and a static eliminator 24 in this order in the direction of rotation of the image carrier 12. The image forming apparatus 10 also includes a fixing device 26, which has a fixing member 26A and a pressure member 26B in contact with the fixing member 26A. The image forming apparatus 10, moreover, has a control device 36, which controls the operation of each device (section). The image carrier 12, charging device 15, electrostatic charge image forming device 16, developing device 18, transfer device 31, cleaning device 22, and lubricant supplying device 64 are sections of an image forming unit.

The image forming apparatus 10 may have a process cartridge that includes at least the image carrier 12 and in which the image carrier 12 is integrated with other devices.

The following describes each device (section) of the image forming apparatus 10 in detail.

Image Carrier

The image carrier of an image forming apparatus according to this exemplary embodiment has a photosensitive layer.

The photosensitive layer may be a single-layer photosensitive layer, which is one single functionally integrated photosensitive layer that contains both charge-generating and charge-transport materials, or may be a functionally divided multilayer photosensitive layer, formed by a charge-generating layer and a charge-transport layer. The charge-generating and charge-transport layers in a multilayer photosensitive layer may be in any order, but by way of example, the image carrier may have a charge-generating layer, a charge-transport layer, and a surface-protecting layer in this order on a conductive substrate. The image carrier may include any other layer(s).

Figure 2:
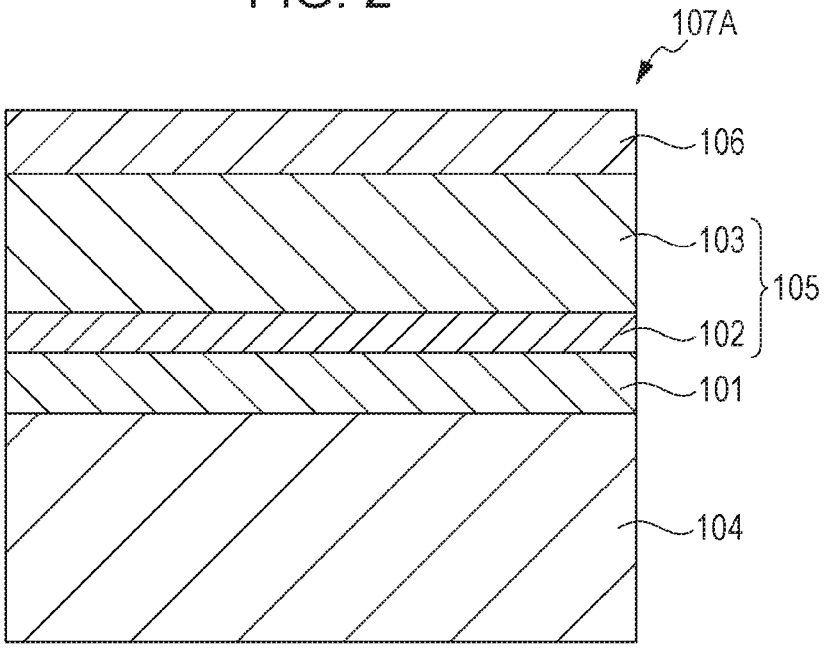
FIG. 2 is a schematic cross-section illustrating an example of a layer structure of the image carrier of an image forming apparatus according to this exemplary embodiment.

FIG. 2 is a schematic cross-section illustrating an example of a layer structure of the image carrier of an image forming apparatus according to this exemplary embodiment. The image carrier 107A has an undercoat layer 101 on a conductive substrate 104. On the undercoat layer 101 are a charge-generating layer 102, a charge-transport layer 103, and a surface-protecting layer 106 formed one after another. The image carrier 107A has a photosensitive layer 105 functionally divided into the charge-generating layer 102 and charge-transport layer 103.

Figure 3:
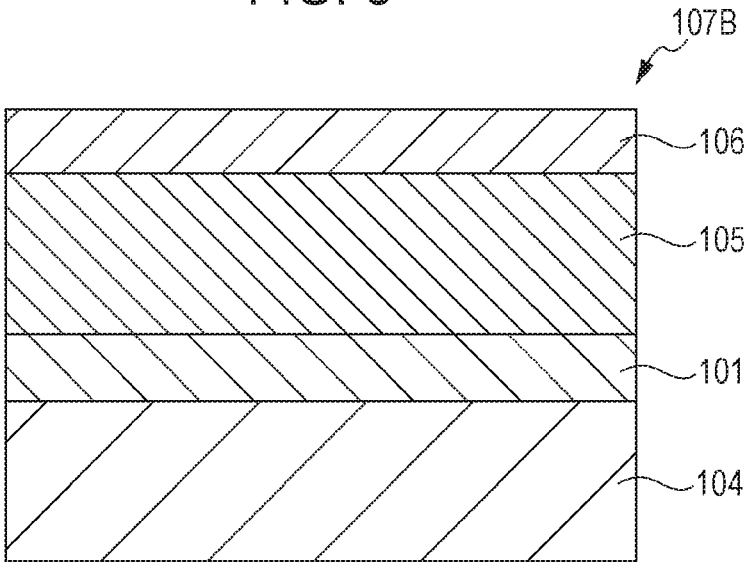
FIG. 3 is a schematic cross-section illustrating another example of a layer structure of the image carrier of an image forming apparatus according to this exemplary embodiment.

FIG. 3 is a schematic cross-section illustrating another example of a layer structure of the image carrier of an image forming apparatus according to this exemplary embodiment. The image carrier 107B in FIG. 3 has an undercoat layer 101 on a conductive substrate 104. On the undercoat layer 101 are a photosensitive layer 105 and a surface-protecting layer 106 formed one after another. The image carrier 107B has a single-layer photosensitive layer, which is one single functionally integrated photosensitive layer 105 that contains both charge-generating and charge-transport materials.

The undercoat layer 101 is optional; it may be that an image carrier according to this exemplary embodiment has no undercoat layer.

The following describes the image carrier according to this exemplary embodiment in detail. In the following, the image carrier and its structural elements are mentioned without designators.

Conductive Substrate

The conductive substrate may be, for example, a metal plate, metal drum, or metal belt that contains a metal (e.g., aluminum, copper, zinc, chromium, nickel, molybdenum, vanadium, indium, gold, or platinum) or alloy (e.g., stainless steel). Alternatively, the conductive substrate may be, for example, a piece of paper, resin film, or belt with a layer of a conductive compound (e.g., a conductive polymer or indium oxide), metal (e.g., aluminum, palladium, or gold), or alloy thereon formed by coating, deposition, or lamination. The term "conductive" here means that the substrate has a volume resistivity of less than $10^{13}$ Ωcm.

If the image carrier is used with a laser printer, the conductive substrate may have its surface roughened to a center-line average roughness Ra of 0.04 μm or more and 0.5 μm or less so that the interference fringes, which occur when the image carrier is irradiated with laser light, will weaken. The use of an incoherent source also helps prevent interference fringes, but even if such a light source is used, surface roughening helps extend the service life of the image carrier by reducing defects caused by an uneven surface of the conductive substrate.

Examples of surface roughening methods include wet honing, which means spraying an aqueous suspension of an abrasive onto the support, centerless grinding, which is continuous grinding of the conductive substrate with a grindstone pressed against the substrate, and anodization.

Alternatively, a layer instead may be formed on the surface of the conductive substrate by dispersing a conductive or semiconducting powder in a resin and then applying the resin to the surface of the conductive substrate. The particles dispersed in the layer roughen the surface.

Surface roughening by anodization is to anodize a metal (e.g., aluminum) conductive substrate in an electrolyte solution and thereby to form an oxide film on the surface of the conductive substrate. The electrolyte solution may be, for example, a solution of sulfuric acid or oxalic acid. The porous anodic oxide film freshly formed by anodization, however, is chemically active, prone to contamination, and greatly changes its resistance with changes in the environment where it is. This may be addressed by subjecting the porous anodic oxide film to a sealing process, in which the oxide film is exposed to high-pressure steam or put into boiling water (optionally with a salt of nickel or any other metal therein). Hydration seals the pores in the oxide film by swelling the volume of the film, and the resulting hydrated oxide is more stable than the initial oxide.

The thickness of the anodic oxide film may be, for example, 0.3 μm or more and 15 μm or less. This tends to help give the film barrier properties against injection, and also tends to help reduce the increase in residual potential after repeated use.

The conductive substrate may be treated with an acidic treatment fluid or by the boehmite process.

The treatment with an acidic treatment fluid may be, for example, as follows. First, an acidic treatment fluid containing phosphoric acid, chromic acid, and hydrofluoric acid is prepared. The percentages of phosphoric acid, chromic acid, and hydrofluoric acid in the acidic treatment fluid may be 10% by mass or more and 11% by mass or less, 3% by mass or more and 5% by mass or less, and 0.5% by mass or more and 2% by mass or less, respectively, and the total concentration of these acids may be 13.5% by mass or more and 18% by mass or less. The temperature at which the treatment is performed may be, for example, 42° C. or more and 48° C. or less. The thickness of the resulting coating may be 0.3 μm or more and 15 μm or less.

The boehmite process is performed by, for example, immersing the conductive substrate in purified water at 90° C. or more and 100° C. or less for 5 to 60 minutes or exposing the conductive substrate to heated steam at 90° C. or more and 120° C. or less for 5 to 60 minutes. The thickness of the resulting coating may be 0.1 μm or more and 5 μm or less. This coating may optionally be anodized using an electrolyte solution that dissolves little of the coating, such as a solution of adipic acid, boric acid, a borate, a phosphate, a phthalate, a maleate, a benzoate, a tartrate, or a citrate.

Undercoat Layer

The undercoat layer is, for example, a layer that contains inorganic particles and a binder resin.

The inorganic particles may be, for example, inorganic particles having a powder resistivity (volume resistivity) of $10^2$ Ωcm or more and $10^{11}$ Ωcm or less. Examples of inorganic particles having such a resistance value include particles of metal oxides, such as particles of tin oxide, titanium oxide, zinc oxide, and zirconium oxide. Particles of zinc oxide are preferred.

The specific surface area of the inorganic particles as measured by the Brunauer-Emmett-Teller (BET) method may be, for example, 10 $m^2/g$ or more.

The volume-average diameter of the inorganic particles may be, for example, 50 nm or more and 2000 nm or less (preferably 60 nm or more and 1000 nm or less).

The amount of the inorganic particles may be, for example, 10% by mass or more and 80% by mass or less, preferably 40% by mass or more and 80% by mass or less, of the binder resin.

The inorganic particles may be surface-treated ones. Even a mixture of two or more types of inorganic particles with different surface treatments or diameters may be used.

Examples of surface treatment agents include silane coupling agents, titanate coupling agents, aluminum coupling agents, and surfactants. Silane coupling agents are preferred, more preferably amino-containing silane coupling agents.

Examples of amino-containing silane coupling agents include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

A mixture of two or more silane coupling agents may also be used. For example, an amino-containing silane coupling agent may be used in combination with an extra silane coupling agent, whether amino-containing or not. Examples of extra silane coupling agents include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment with a surface treatment agent may be by any known process. Both dry and wet processes are acceptable.

The amount of surface treatment agent used for the treatment may be, for example, 0.5% by mass or more and 10% by mass or less of the inorganic particles.

Besides the inorganic particles, the undercoat layer may contain an electron-accepting compound (acceptor compound) in view of the improvement of the long-term stability of electrical properties and carrier-blocking properties.

Examples of electron-accepting compounds include electron-transporting substances, such as chloranil, bromanil, and other quinone compounds; tetracyanoquinodimethane compounds; fluorenone compounds, such as 2,4,7-trinitrofluorenone and 2,4,5,7-tetranitro-9-fluorenone; 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole, and other oxadiazole compounds; xanthone compounds; thiophene compounds; and 3,3',5,5'-tetra-t-butyldiphenoquinone and other diphenoquinone compounds.

Compounds having the anthraquinone structure may also be used as electron-accepting compounds. Examples of compounds having the anthraquinone structure include hydroxyanthraquinone compounds, aminoanthraquinone compounds, and aminohydroxyanthraquinone compounds, specifically anthraquinone, alizarin, quinizarin, anthrarufin, and purpurin.

The electron-accepting compound may be contained dispersed with the inorganic particles or adhering to the surface of the inorganic particles in the undercoat layer.

The adhesion of the electron-accepting compound to the surface of the inorganic particles may be achieved by, for example, a dry process or a wet process.

An example of a dry process is to attach the electron-accepting compound to the surface of the inorganic particles by adding drops of or spraying the compound, either directly or as a solution in an organic solvent, together with dry air or nitrogen gas while stirring the inorganic particles, for example with a high-shear mixer. The addition or spraying of the electron-accepting compound may be done at temperatures equal to or lower than the boiling point of the solvent. The added or sprayed electron-accepting compound may be baked at 100° C. or above. Any type of baking may be performed as long as electrophotographic properties are obtained under the selected temperature and time conditions.

The wet process is to attach the electron-accepting compound to the surface of the inorganic particles by dispersing the inorganic particles in a solvent, for example by stirring or sonication or using a sand mill, an attritor, or a ball mill, stirring the dispersion with the electron-accepting compound or dispersing the compound in the dispersion, and then removing the solvent. The removal of the solvent is achieved by, for example, filtration or distillation. After the removal of the solvent, the electron-accepting compound may be baked at 100° C. or above. Any type of baking may be performed as long as electrophotographic properties are obtained under the selected temperature and time conditions. A wet process may include removing water from the inorganic particles, for example while stirring and heating the particles in a solvent or boiling the particles with a solvent, before the addition of the electron-accepting compound.

The attachment of the electron-accepting compound may be before or after the surface treatment of the inorganic particles with a surface treatment agent or may be simultaneous with the surface treatment with a surface treatment agent.

The amount of the electron-accepting compound may be, for example, 0.01% by mass or more and 20% by mass or less, preferably 0.01% by mass or more and 10% by mass or less, of the inorganic particles.

As for the binder resin in the undercoat layer, examples include known materials such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, epoxy resins, and other known polymer compounds; zirconium chelate compounds; titanium chelate compounds; aluminum chelate compounds; titanium alkoxide compounds; organic titanium compounds; and silane coupling agents.

Resins like electron-transporting resins, which have electron-transporting group(s), and conductive resins (e.g., polyanilines) are also examples of binder resins in the undercoat layer. The binder resin in the undercoat layer may be a resin insoluble in the solvent used to form the upper layer, preferably a resin obtained by reacting at least one resin selected from the group consisting of thermosetting resins, such as urea resins, phenolic resins, phenol-formaldehyde resins, melamine resins, urethane resins, unsaturated polyester resins, alkyd resins, and epoxy resins; polyamide resins, polyester resins, polyether resins, methacrylic resins, acrylic resins, polyvinyl alcohol resins, and polyvinyl acetal resins with a curing agent.

If two or more of these binder resins are used in combination, their proportions are determined as appropriate.

The undercoat layer may contain additives for improving electrical properties, environmental stability, and/or image quality.

Additives that may be used include known materials such as condensed polycyclic, azo, and other electron-transporting pigments, zirconium chelate compounds, titanium chelate compounds, aluminum chelate compounds, titanium alkoxide compounds, organic titanium compounds, and silane coupling agents. Silane coupling agents may be used for the surface treatment of the inorganic particles as mentioned above, but may further be contained in the undercoat layer as additives.

Examples of silane coupling agents as additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of aluminum chelate compounds include aluminum isopropylate, monobutoxyaluminum diisopropylate, aluminum butyrate, diethyl acetoacetate aluminum isopropylate, and aluminum tris(ethyl acetoacetate).

These additives may be used alone or as a mixture or polycondensate of multiple compounds.

The undercoat layer may have a Vickers hardness of 35 or more.

The surface roughness (ten-point height of irregularities) of the undercoat layer may be between 1/(4n) (where n is the refractive index of the upper layer) and 1/2 of the wavelength λ of the laser for exposure so that moiré fringes will weaken.

The surface roughness of the undercoat layer may be adjusted by the addition of, for example, resin particles. The resin particles may be, for example, particles of a silicone resin or particles of a crosslinked polymethyl methacrylate resin. The surface roughness adjustment may alternatively be achieved by smoothing the surface of the undercoat layer. Smoothing methods that may be used include buffing, sandblasting, wet honing, and grinding.

The formation of the undercoat layer may be by any known method. An example is to form a coating of a liquid prepared by adding the above ingredients to a solvent (liquid for undercoat layer formation), dry the coating, and then optionally heat the coating.

Examples of solvents that may be used to prepare the liquid for undercoat layer formation include alcohol solvents, aromatic hydrocarbon solvents, halogenated hydrocarbon solvents, ketone solvents, ketone alcohol solvents, ether solvents, ester solvents, and other known organic solvents.

Specific examples of these solvents include common organic solvents, such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

In preparing the liquid for undercoat layer formation, the dispersion of the inorganic particles may be by a known method, such as a roller mill, ball mill, vibration ball mill, attritor, sand mill, colloid mill, or paint shaker.

The application of the liquid for undercoat layer formation to the conductive substrate may be by a usual method, such as blade coating, wire bar coating, spray coating, dip coating, bead coating, air knife coating, or curtain coating.

The thickness of the undercoat layer may be, for example, 15 μm or more, preferably 20 μm or more and 50 μm or less.

Intermediate Layer

Although not illustrated, there may be an intermediate layer between the undercoat layer and the photosensitive layer.

The intermediate layer is, for example, a layer that contains a resin. Examples of resins that may be used in the intermediate layer include acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins, and other polymer compounds.

The intermediate layer may alternatively be a layer that contains an organometallic compound. Examples of organometallic compounds that may be used in an intermediate layer include those organometallic compounds that have, for example, a zirconium, titanium, aluminum, manganese, or silicon atom.

These compounds that may be used in the intermediate layer may be used alone or as a mixture or polycondensate of multiple compounds.

Preferably, the intermediate layer is a layer that contains an organometallic compound containing a zirconium or silicon atom.

The formation of the intermediate layer may be by any known method. An example is to form a coating of a liquid prepared by adding any of the above ingredients to a solvent (liquid for intermediate layer formation), dry the coating, and then optionally heat the coating.

The coating for the formation of the intermediate layer may be by a usual method, such as dip coating, push coating, wire bar coating, spray coating, blade coating, knife coating, or curtain coating.

The thickness of the intermediate layer may be, for example, 0.1 μm or more and 3 μm or less. An intermediate layer may be used as the undercoat layer.

Charge-Generating Layer

The charge-generating layer is, for example, a layer that contains a charge-generating material and a binder resin. Alternatively, the charge-generating layer may be a layer of a charge-generating material formed by deposition. The use of an incoherent source, such as a light-emitting diode (LED) or organic electroluminescence (EL) image array, is an exemplary case in which a layer of a charge-generating material formed by deposition may be used.

Examples of charge-generating materials include bisazo, trisazo, and other azo pigments; dibromoanthanthrone and other annulated aromatic pigments; perylene pigments; pyrrolopyrrole pigments; phthalocyanine pigments; zinc oxide; and trigonal selenium.

To be responsive to light from a near-infrared laser, the charge-generating material may be a metal phthalocyanine pigment or non-metal phthalocyanine pigment. Specific examples include those hydroxygallium phthalocyanines disclosed in, for example, Japanese Laid Open Patent Application Publication Nos. 5-263007 and 5-279591; those chlorogallium phthalocyanines disclosed in, for example, Japanese Laid Open Patent Application Publication No. 5-98181; those dichlorotin phthalocyanines disclosed in, for example, Japanese Laid Open Patent Application Publication Nos. 5-140472 and 5-140473; and those titanyl phthalocyanines disclosed in, for example, Japanese Laid Open Patent Application Publication No. 4-189873.

To be responsive to light from a near-ultraviolet laser, the charge-generating material may be, for example, an annulated aromatic pigment, such as dibromoanthanthrone; a thioindigo pigment; a porphyrazine compound; zinc oxide; trigonal selenium; or any of those bisazo pigments disclosed in Japanese Laid Open Patent Application Publication Nos. 2004-78147 and 2005-181992.

These charge-generating materials may be used even if the light source is an LED, organic EL image array, or other incoherent source having a central emission wavelength of 450 nm or more and 780 nm or less. If a thin photosensitive layer having a thickness of 20 μm or less is used in view of image resolution, however, the electric field strength in the photosensitive layer is high, and the injection of charge from the substrate often causes low charge, or the image defect called black spots. This is serious if the charge-generating material is a p-type semiconductor and therefore easily produces dark current, for example if the charge-generating material is trigonal selenium or a phthalocyanine pigment.

By contrast, n-type semiconductors, such as annulated aromatic pigments, perylene pigments, and azo pigments, do not easily produce dark current when used as charge-generating materials. With such a charge-generating material, therefore, the image defect called black spots is mitigated even if the photosensitive layer is thin. Examples of n-type charge-generating materials include, but are not limited to, compounds (CG-1) to (CG-27) in paragraphs to of Japanese Laid Open Patent Application Publication No. 2012-155282.

Whether a charge-generating material is n-type is determined by the polarity of the photocurrent that flows therethrough in the commonly used time-of-flight method. The material is n-type if the carrier electrons flow more easily therethrough than holes.

The binder resin in the charge-generating layer is selected from a wide range of insulating resins. Alternatively, the binder resin may be selected from organic photoconductive polymers, such as poly-N-vinylcarbazole, polyvinylanthracene, polyvinylpyrene, and polysilanes.

Examples of binder resins include polyvinyl butyral resins, polyarylate resins (e.g., polycondensates of a bisphenol and an aromatic dicarboxylic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins. The term "insulating" here means that the resin has a volume resistivity of $10^{13}$ Ωcm or more.

One of these binder resins alone or a mixture of two or more are used.

The proportions of the charge-generating material and the binder resin(s) may be between 10:1 and 1:10 in a mass ratio.

Besides these ingredients, the charge-generating layer may contain known additives.

The formation of the charge-generating layer may be by any known method. An example is to form a coating of a liquid prepared by adding the above ingredients to a solvent (liquid for charge-generating layer formation), dry the coating, and then optionally heat the coating. The charge-generating layer may alternatively be formed by the deposition of a layer of the charge-generating material, particularly if the charge-generating material is an annulated aromatic pigment or perylene pigment.

Examples of solvents that may be used to prepare the liquid for charge-generating layer formation include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. One of these solvents may be used alone, or two or more may be used as a mixture.

The dispersion of particles (e.g., the charge-generating material) in the liquid for charge-generating layer formation may be through the use of, for example, a medium disperser, such as a ball mill, vibration ball mill, attritor, sand mill, or horizontal sand mill, or a mediumless disperser, such as a stirrer, sonicator, roller mill, or high-pressure homogenizer. The high-pressure homogenizer may be, for example, an impact homogenizer, which disperses materials by causing a liquid dispersion to hit itself or a wall at high pressure, or a shear homogenizer, which disperses materials by forcing them through a very narrow channel at high pressure.

This process of dispersion may be performed until the average particle diameter of the charge-generating material in the liquid for charge-generating layer formation is 0.5 μm or less, preferably 0.3 μm or less, more preferably 0.15 μm or less.

The application of the liquid for charge-generating layer formation to the undercoat layer (or intermediate layer) may be by a usual method, such as blade coating, wire bar coating, spray coating, dip coating, bead coating, air knife coating, or curtain coating.

The thickness of the charge-generating layer may be, for example, 0.1 μm or more and 5.0 μm or less, preferably 0.2 μm or more and 2.0 μm or less.

Charge-Transport Layer

The charge-transport layer is, for example, a layer that contains a charge-transport material and a binder resin. Alternatively, the charge-transport layer may be a layer that contains a polymeric charge-transport material.

Examples of charge-transport materials include electron-transporting compounds, such as p-benzoquinone, chloranil, bromanil, and anthraquinone, and other quinone compounds; tetracyanoquinodimethane compounds; 2,4,7-trinitrofluorenone and other fluorenone compounds; xanthone compounds; benzophenone compounds; cyanovinyl compounds; and ethylene compounds. Hole-transporting compounds, such as triarylamine compounds, benzidine compounds, arylalkane compounds, aryl-substituted ethylene compounds, stilbene compounds, anthracene compounds, and hydrazone compounds, are also examples of charge-transport materials that may be used. One of these charge-transport materials alone or two or more are used, but these are not the only charge-transport materials that may be used.

In view of charge mobility, the charge-transport material may be one of those triarylamine derivatives represented by structural formula (a-1) and those benzidine compounds represented by structural formula (a-2).

(a-1)

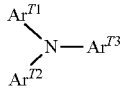

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$ $R^{T4}$, $R^{T5}$, $R^{T6}$, $R^{T7}$, and $R^{T8}$ each independently represent a hydrogen atom, substituted or unsubstituted alkyl group, or substituted or unsubstituted aryl group.

Examples of substituents each of the above groups may have include halogen atoms, C1-5 alkyl groups, and C1-5 alkoxy groups. Amino groups substituted with C1-3 alkyl group(s) are also examples of possible substituents.

(a-2)

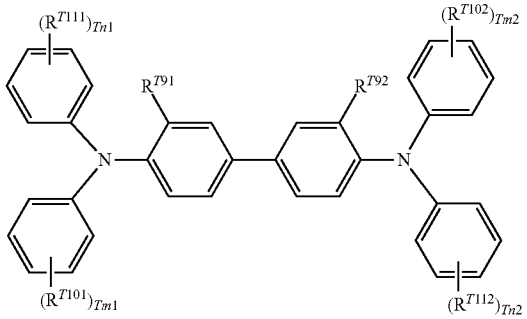

In structural formula (a-2), $R^{T91}$ and $R^{T92}$ each independently represent a hydrogen atom, halogen atom, C1-5 alkyl group, or C1-5 alkoxy group. $R^{T101}$, $R^{T102}$, $R^{T111}$, and $R^{T112}$ each independently represent a halogen atom, C1-5 alkyl group, C1-5 alkoxy group, amino group substituted with C1-2 alkyl group(s), substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$, and $R^{T16}$ each independently represent a hydrogen atom, substituted or unsubstituted alkyl group, or substituted or unsubstituted aryl group. Tm1, Tm2, Tn1, and Tn2 each independently represent an integer of 0 to 2.

Examples of substituents each of the above groups may have include halogen atoms, C1-5 alkyl groups, and C1-5 alkoxy groups. Amino groups substituted with C1-3 alkyl group(s) are also examples of possible substituents.

Of those triarylamine derivatives represented by structural formula (a-1) and those benzidine derivatives represented by structural formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are preferred in view of charge mobility.

Examples of polymeric charge-transport materials include poly-N-vinylcarbazole, polysilanes, and other known polymeric charge transporters. Those polyester charge-transport materials disclosed in, for example, Japanese Laid Open Patent Application Publication Nos. 8-176293 and 8-208820 may also be used. Polymeric charge-transport materials may be used alone but may alternatively be used in combination with a binder resin.

Examples of binder resins that may be used in the charge-transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, and polysilanes. Preferably, the binder resin is a polycarbonate or polyarylate resin. One of these binder resins alone or two or more are used.

The proportions of the charge-transport material and the binder resin(s) may be between 10:1 and 1:5 in a mass ratio.

Besides these ingredients, the charge-transport layer may contain known additives.

The formation of the charge-transport layer may be by any known method. An example is to form a coating of a liquid prepared by adding the above ingredients to a solvent (liquid for charge-transport layer formation), dry the coating, and then optionally heat the coating.

Examples of solvents that may be used to prepare the liquid for charge-transport layer formation include common organic solvents, such as benzene, toluene, xylene, chlorobenzene, and other aromatic hydrocarbons; acetone, 2-butanone, and other ketones; methylene chloride, chloroform, ethylene chloride, and other halogenated aliphatic hydrocarbons; tetrahydrofuran, ethyl ether, and other cyclic or linear ethers. One of these solvents alone or a mixture of two or more is used.

The application of the liquid for charge-transport layer formation to the charge-generating layer may be by a usual method, such as blade coating, wire bar coating, spray coating, dip coating, bead coating, air knife coating, or curtain coating.

The thickness of the charge-transport layer may be, for example, 5 μm or more and 50 μm or less, preferably 10 μm or more and 30 μm or less.

Protecting Layer

The protecting layer is an optional layer that may be formed on the photosensitive layer. The protecting layer is intended to, for example, prevent chemical alteration of a charged photosensitive layer and/or further improve the mechanical strength of the photosensitive layer. The protecting layer may therefore be a layer of cured coating (crosslinked coating). The layers specified below as 1) and 2) are examples of such layers.

1) A layer of coating formed by curing a composition that contains at least one material having a reactive group and a charge-transporting structure in the same molecule (reactive-group-containing charge-transport material). That is, a layer containing a polymer or the crosslinked form of the reactive-group-containing charge-transport material.

2) A layer of coating formed by curing a composition that contains a nonreactive charge-transport material and a material having a reactive group and no charge-transporting structure (reactive-group-containing non-charge-transport material). That is, a layer containing the nonreactive charge-transport material and a polymer or the crosslinked form of the reactive-group-containing non-charge-transport material.

The reactive group in the reactive-group-containing charge-transport material may be a known reactive group, such as a group capable of chain polymerization, the epoxy group, —OH, —OR [where R represents an alkyl group], —$NH_2$, —SH, —COOH, or —$SiR^{Q1}_{3-Qn}(OR^{Q2})_{Qn}$ [where $R^{Q1}$ represents a hydrogen atom, alkyl group, or substituted or unsubstituted aryl group, $R^{Q2}$ represents a hydrogen atom, alkyl group, or trialkylsilyl group, and Qn represents an integer of 1 to 3]. These known reactive groups are also examples of reactive groups that may be used in a reactive-group-containing non-charge-transport material.

The group capable of chain polymerization may be any radically polymerizable functional group. For example, it may be a functional group that has at least a group containing a carbon double bond. Specific examples include groups that contain at least one selected from a vinyl group, a vinyl ether group, a vinyl thioether group, a styryl (vinylphenyl) group, an acryloyl group, a methacryloyl group, and derivatives thereof. The group capable of chain polymerization is preferably a group that contains at least one selected from a vinyl group, a styryl (vinylphenyl) group, an acryloyl group, a methacryloyl group, and derivatives thereof due to its superior reactivity.

The charge-transporting structure in the reactive-group-containing charge-transport material may be any such structure known to be used in an image carrier. Examples include structures derived from a nitrogen-containing hole-transporting compound, such as a triarylamine compound, benzidine compound, or hydrazone compound, and forming a conjugated system with the nitrogen atom(s). A triarylamine structure is preferred.

The reactive-group-containing charge-transport material, which has a reactive group and a charge-transporting structure as described above, or the nonreactive charge-transport and reactive-group-containing non-charge-transport materials can be selected from known materials.

Besides these ingredients, the protecting layer may contain known additives.

The formation of the protecting layer may be by any known method. An example is to form a coating of a liquid prepared by adding the above ingredients to a solvent (liquid for protecting layer formation), dry the coating, and then optionally perform curing, for example by heating.

Examples of solvents that may be used to prepare the liquid for protecting layer formation include aromatic solvents, such as toluene and xylene; ketone solvents, such as methyl ethyl ketone, methyl isobutyl ketone, and cyclohexanone; ester solvents, such as ethyl acetate and butyl acetate; ether solvents, such as tetrahydrofuran and dioxane; cellosolve solvents, such as ethylene glycol monomethyl ether; and alcohol solvents, such as isopropyl alcohol and butanol. These solvents are used alone or as a mixture of two or more.

The liquid for protecting layer formation, however, may be a solventless liquid.

The application of the liquid for protecting layer formation to the photosensitive layer (e.g., the charge-transport layer) may be by a usual method, such as dip coating, push coating, wire bar coating, spray coating, blade coating, knife coating, or curtain coating.

The thickness of the protecting layer may be, for example, 1 μm or more and 20 μm or less, preferably 2 μm or more and 10 μm or less.

Single-Layer Photosensitive Layer

A single-layer photosensitive layer (charge-generating/charge-transport layer) is a layer that contains, for example, a charge-generating material and a charge-transport material and optionally a binder resin and known additives. The details of these materials are as described for those in the charge-generating layer and the charge-transport layer.

In the single-layer photosensitive layer, the amount of the charge-generating material may be 0.1% by mass or 10% by mass or less, preferably 0.8% by mass or more and 5% by mass or less, of the total solids content, and the amount of the charge-transport material may be 5% by mass or more and 50% by mass or less of the total solids content.

As for formation, examples of possible methods are the same as those for the formation of a charge-generating layer or a charge-transport layer.

The thickness of the single-layer photosensitive layer may be, for example, 5 μm or more and 50 μm or less, preferably 10 μm or more and 40 μm or less.

Charging Device

The charging device 15 charges the surface of the image carrier 12. The charging device 15 includes, for example, a charging member 14 and a power supply 28. The charging member 14 charges the surface of the image carrier 12, whether it touches or does not touch the surface of the image carrier 12, and the power supply 28 applies a charging voltage to the charging member 14 (example of a voltage supplier for the charging member). The power supply 28 is electrically coupled to the charging member 14.

The charging member 14 of the charging device 15 may be, for example, a contact charger that uses a conductive charging roller, charging brush, charging film, charging rubber blade, charging tube, etc. Alternatively, the charging member 14 may be, for example, a noncontact roller charger, a scorotron or corotron charger, which uses a corona discharge, or any other charger known in itself.

Electrostatic Charge Image Forming Device

The electrostatic charge image forming device 16 forms an electrostatic charge image on the charged surface of the image carrier 12. To be more specific, the electrostatic charge image forming device 16 in an exemplary configuration emits light L toward the surface of the image carrier 12 charged by the charging member 14. The light L has been modulated on the basis of image information of the image to be formed. As a result, an electrostatic charge image is formed on the image carrier 12 in accordance with the image of the image information.

The electrostatic charge image forming device 16 may be, for example, a piece of optical equipment that has a light source with which a target can be exposed to a pattern of light, for example from a semiconductor laser, an LED, or through a liquid crystal shutter.

Developing Device

The developing device 18 is located, for example, downstream of the point of the irradiation with light L by the electrostatic charge image forming device 16 in the direction of rotation of the image carrier 12. Inside the developing device 18 is a container for a developing agent. The container contains a developer that has a specific toner for electrostatic charge image development (electrostatic charge image developer). In an exemplary configuration, the toner is contained charged in the developing device 18.

The developing device 18 includes, for example, a developing member 18A and a power supply 32. The developing member 18A develops the electrostatic charge image formed on the surface of the image carrier 12 with a developer that includes toner for electrostatic charge image development, and the power supply 32 applies a developing voltage to the developing member 18A. The developing member 18A is, for example, electrically coupled to the power supply 32.

The developing member 18A of the developing device 18 is selected in accordance with the type of developer used. An example is a developing roller that has a developing sleeve with a built-in magnet.

The developing device 18 (including the power supply 32) is electrically coupled to, for example, a control device 36 that is part of the image forming apparatus 10. Under the control of the control device 36, the developing device 18 applies a developing voltage to the developing member 18A. The application of a developing voltage makes the developing member 18A charged to a developing potential determined by the developing voltage. The developing member 18A charged to a developing potential then supplies the toner, included in the developer contained in the developing device 18, from the inside of the developing device 18 to the surface of the image carrier 12, for example by holding the developer on its surface. On the surface of the image carrier 12, fed with the toner, the electrostatic charge image formed thereon is developed into a toner image for electrostatic charge image development.

Transfer Device

The transfer device 31 is located, for example, downstream of the developing member 18A in the direction of rotation of the image carrier 12. The transfer device 31 includes, for example, a transfer member 20 and a power supply 30. The transfer member 20 transfers the toner image for electrostatic charge image development formed on the surface of the image carrier 12 to a recording medium 30A, and the power supply 30 applies a transfer voltage to the transfer member 20. The transfer member 20 is, for example, cylindrical, and the image carrier 12 and the transfer member 20 transport the recording medium 30A by sandwiching it therebetween. The transfer member 20 is, for example, electrically coupled to the power supply 30.

The transfer member 20 may be, for example, a contact transfer charger that uses a belt, roller, film, rubber cleaning blade, etc., or may be a noncontact transfer charger known in itself, such as a scorotron or corotron transfer charger, which uses a corona discharge.

The transfer device 31 (including the power supply 30) is electrically coupled to, for example, a control device 36 that is part of the image forming apparatus 10. Under the control of the control device 36, the transfer device 31 applies a transfer voltage to the transfer member 20. The application of a transfer voltage makes the transfer member 20 charged to a transfer potential determined by the transfer voltage.

The transfer voltage has the opposite polarity to the toner forming the toner image for electrostatic charge image development on the image carrier 12. The application of the transfer voltage by the power supply 30 of the transfer member 20 to the transfer member 20 produces, for example, a transfer electric field in the region in which the image carrier 12 and the transfer member 20 face each other (see the transfer region 32A in FIG. 1). The transfer electric field has a field strength that provides an electrostatic force that moves each particle of the toner forming the toner image for electrostatic charge image development on the image carrier 12 from the image carrier 12 to the transfer member 20.

The recording medium 30A reaches the transfer region 32A, the region in which the image carrier 12 and the transfer member 20 face each other, for example by being transported by multiple transport members not illustrated from its container, not illustrated, along a transport route 34. In FIG. 1, the recording medium 30A is transported in the direction of arrow B. While the recording medium 30A is in the transfer region 32A, the toner image for electrostatic charge image development on the image carrier 12 is transferred thereto, for example by the transfer electric field produced in that region by the transfer voltage applied to the transfer member 20. That is, the toner image for electrostatic charge image development is transferred to the recording medium 30A, for example by the toner moving from the surface of the image carrier 12 to the recording medium 30A. Then the toner image for electrostatic charge image development on the image carrier 12 is transferred to the recording medium 30A by the transfer electric field.

Lubricant Supplying Device

The lubricant supplying device 64 is located downstream of the transfer device 31 in the direction of rotation of the image carrier 12 and has a lubricant 66A and a lubricant supplying member 66B. The lubricant supplying device 64 is in contact with the surface of the image carrier 12. Although not illustrated, the lubricant supplying device 64 may have a plate that mechanically knocks the toner from the rotary brush to which the toner is adhering.

Lubricant 66A

Examples of lubricants include salts of fatty acids and metals (fatty acid metal salts) and insulating lubricants. Preferably, the lubricant contains at least one fatty acid metal salt.

The fatty acid in a fatty acid metal salt may be a saturated fatty acid or unsaturated fatty acid. An example of a fatty acid in a fatty acid metal salt is a C10-25 (the carbon atom in the carboxy group included; preferably C12-22) fatty acid. The metal in a fatty acid metal salt may be a divalent metal. Examples of metals that may be used in a fatty acid metal salt include magnesium, calcium, aluminum, barium, and zinc, and zinc is preferred.

A fatty acid metal salt may be, for example, a metal salt of stearic acid, a metal salt of palmitic acid, a metal salt of lauric acid, a metal salt of oleic acid, a metal salt of linoleic acid, or a metal salt of ricinoleic acid. Preferably, the lubricant contains at least one fatty acid metal salt selected from metal salts of stearic acid and metal salts of lauric acid, more preferably at least one selected from zinc stearate and zinc laurate, even more preferably zinc stearate. One fatty acid metal salt may be used alone, or two or more may be used in combination.

Lubricant Supplying Member 66B

The lubricant supplying member 66B in an exemplary configuration is placed in contact with a solid lubricant 66A and the image carrier 12. The lubricant supplying member 66B supplies the lubricant 66A to the point at which it touches the image carrier 12.

The lubricant supplying member 66B may be, for example, a rotary brush or a rubber roller. Preferably, the lubricant supplying member 66B is a rotary brush.

If the lubricant supplying member 66B is a rotary brush, streak-shaped image defects and image deletion tend to be more likely to occur during repeated image formation using the image forming apparatus 10 because in this case it is likely that the lubricant supplying member 66B catches much residual toner. In this exemplary embodiment, the use of a toner according to this exemplary embodiment reduces both streak-shaped image defects and image deletion even if the lubricant supplying member 66B of the image forming apparatus 10 is a rotary brush.

The lubricant supplying device 64 in an exemplary configuration may supply the lubricant 66A to the surface of the image carrier 12 by applying the lubricant 66A to the lubricant supply member 66B and applying the surface of the lubricant supply member 66B holding the lubricant 66A applied thereto on the surface of the image carrier 12. For example, if the lubricant supply member 66B is a rotary brush, the rotary brush that is the lubricant supply member 66B is rotated while in contact with the lubricant 66A and also with the image carrier 12 as illustrated in FIG. 1. This causes the lubricant 66A to apply to the rotary brush and the applying lubricant 66A to be applied to the surface of the image carrier 12. The lubricant 66A applied to the surface of the image carrier 12 forms a coating of the lubricant 66A on the surface of the image carrier 12.

The fibers of the rotary brush may be resin fibers, such as nylon, acrylic, polypropylene, or polyester fibers.

The rotary brush may be one that has, for example, a fiber density of $15\times10^3$ fibers/inch$^2$ or more and $120\times10^3$ fibers/inch$^2$ or less (23.4 fibers/mm$^2$ or more and 186 fibers/mm$^2$ or less), a filament length of 1.0 mm or more and 7.0 mm or less, and a fiber thickness of 0.5 deniers or more and 30 deniers or less.

The indentation of the fibers of the rotary brush into the surface of the image carrier 12 may be, for example, 0.3 mm or more and 1.5 mm or less.

The speed of rotation of the rotary brush or rubber roller may be changed in accordance with the circumferential velocity of the image carrier 12. For example, the relative speed with respect to the image carrier 12 may be 0.5 or more and 1.5 or less. The direction of rotation of the rotary brush or rubber roller may be the same as or opposite to that of the image carrier 12.

For the upper limit to the amount of lubricant 66A the lubricant supply member 66B supplies (attaches), the amount per unit area of the image carrier 12 may be, for example, 1.8 μg/cm$^2$ or less in view of the reduction of streak-shaped image defects during repeated image formation. Preferably, the supply of the lubricant 66A is 1.6 μg/cm$^2$ or less, more preferably 1.5 μg/cm$^2$ or less.

As for the lower limit to the amount of lubricant 66A the lubricant supply member 66B supplies (attaches), the amount per unit area of the image carrier 12 may be, for example, 0.05 μg/cm$^2$ or more in view of the reduction of image deletion. Preferably, the supply of the lubricant 66A is 0.08 μg/cm$^2$ or more, more preferably 0.5 μg/cm$^2$ or more.

The supply of the lubricant 66A can be determined as follows. The lubricant is weighed before and after a period of image formation, and the consumption of the lubricant 66A is calculated from the measured weights. Dividing this consumption by the cumulative area of the outer surface of the image carrier 12 that has passed by the lubricant supplying device 66B during the period of image formation gives the supply of the lubricant 66A.

The amount of lubricant 66A the lubricant supply member 66B supplies can be controlled by several methods. If the lubricant supply member 66B is a rotary brush, the supply of the lubricant 66A is controlled by, for example, adjusting the density, filament length, and thickness of the fibers on the surface of the rotary brush, changing the material forming the fibers, and/or customizing the speed of rotation of the rotary brush. The supply of the lubricant 66A may alternatively be controlled by changing the pressure with which the lubricant 66A and the lubricant supply member 66B are pressed against each other. Another possible method is through the use of a mechanism that brings together and separates the lubricant 66A and the lubricant supply member 66B. The mechanism allows the supply of the lubricant 66A to be controlled by controlling the duration of contact between the lubricant 66A and the lubricant supply member 66B.

Cleaning Device

The cleaning device 22 is located downstream of the lubricant supplying device 64 in the direction of rotation of the image carrier 12. After the transfer of the toner image to the recording medium 30A and the supplying of the lubricant from the lubricant supplying device 64 to the surface of the image carrier 12, the cleaning device 22 cleans off residual toner and other substances adhering to the image carrier 12. To be more specific, the cleaning device 22 cleans off discharge products generated by the charging section, paper fibers, and other adhering substances besides residual toner.

The cleaning device 22 has a cleaning blade 220. By contacting the cleaning blade 220 on the surface of the image carrier 12 with its edge against the rotation of the image carrier 12, the cleaning device 22 removes any substance adhering to the surface of the image carrier 12.

Figure 4:
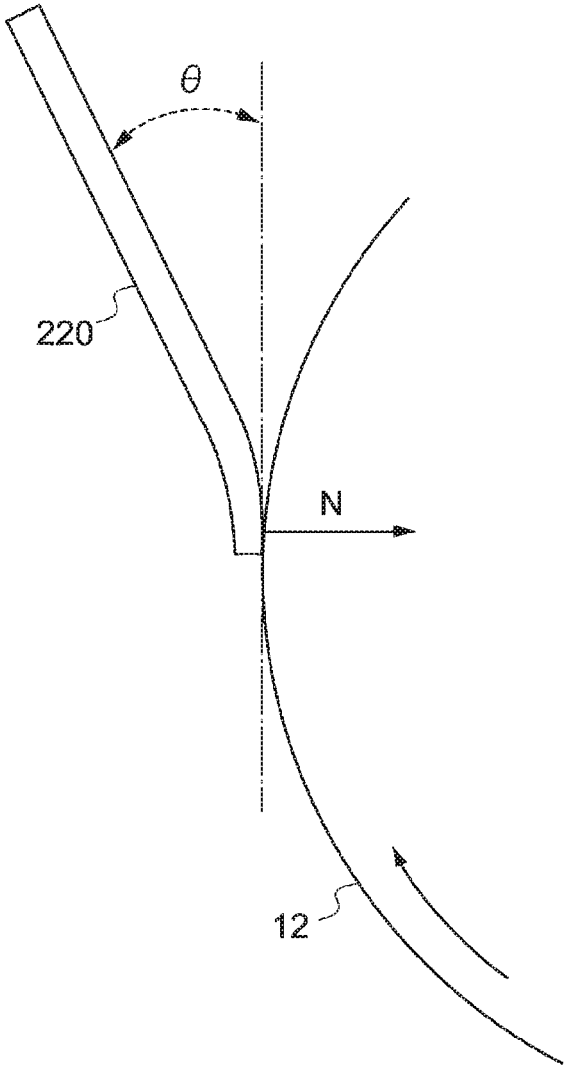
FIG. 4 is an enlarged view of the contact portion between the cleaning blade and the image carrier in the image forming apparatus illustrated in FIG. 1.

The following describes the cleaning device 22 with reference to FIG. 4.

FIG. 4 schematically illustrates a configuration of the cleaning blade 220 in the cleaning device 22 illustrated in FIG. 1.

As illustrated in FIG. 4, the edge of the cleaning blade 220 faces against the rotation of the image carrier 12 (direction of the arrow) and in this state contacts the surface of the image carrier 12.

The angle θ between the cleaning blade 220 and the image carrier 12 may be 5° or more and 35° or less, preferably 10° or more and 25° or less.

The pressure N with which the cleaning blade 220 is pressed against the image carrier 12 may be 0.6 gf/mm$^2$ or more and 6.0 gf/mm$^2$ or less.

To be more specific, the angle θ represents, as illustrated in FIG. 4, the angle formed by the tangent to the point of the image carrier 12 at which it is contacted by the cleaning blade 220 (dash dot line in FIG. 4) and the non-deforming portion of the cleaning blade 220.

Likewise, the pressure N is, as illustrated in FIG. 4, the pressure (gf/mm$^2$) applied toward the center of the image carrier 12 at the point of the image carrier 12 at which it is contacted by the cleaning blade 220.

It should be noted that the cleaning blade 220 in this exemplary embodiment is an elastic plate. The cleaning blade 220 is made of an elastic material, such as silicone rubber, fluororubber, ethylene-propylene-diene rubber, or polyurethane rubber, preferably polyurethane rubber. Polyurethane rubber is superior in mechanical properties, such as wear resistance, chipping resistance, and creep resistance.

The cleaning blade 220 is supported by a support member (not illustrated in FIG. 4) joined to its surface opposite the surface with which it contacts the image carrier 12. By this support member, the cleaning blade 220 is pressed against the image carrier 12 with the aforementioned pressure. The support member may be, for example, a metal material, such as aluminum or stainless steel. There may be an adhesive layer, such as a layer of an adhesive agent, between the support member and the cleaning blade 220 to join them together.

Besides the cleaning blade 220 and a support member supporting it, the cleaning device may include a known member.

Static Eraser

The static eliminator 24 is located, for example, downstream of the cleaning device 22 in the direction of rotation of the image carrier 12. After the transfer of the toner image, the static eraser 24 removes static electricity from the surface of the image carrier 12 by irradiating the surface with light. To be more specific, the static eraser 24 in an exemplary configuration may be electrically coupled to a control device 36 that is part of the image forming apparatus 10. Under the control of the control device 36, the static eraser 24 removes static electricity from the surface of the image carrier 12 by irradiating the entire surface (specifically the entire image forming region, for example) of the image carrier 12.

The static eraser 24 may be, for example, a device that has a tungsten lamp, which emits white light, a light-emitting diode (LED) that emits red light, or any other light source.

Fixing Device

The fixing device 26 is located, for example, downstream of the transfer region 32A in the direction in which the recording medium 30A is transported along the transport route 34. The fixing device 26 has a fixing member 26A and a pressure member 26B in contact with the fixing member 26A and fixes the toner image transferred to the recording medium 30A at the contact portion between the fixing member 26A and the pressure member 26B. To be more specific, the fixing device 26 in an exemplary configuration may be electrically coupled to a control device 36 that is part of the image forming apparatus 10. Under the control of the control device 36, the fixing device 26 applies heat and pressure to the toner image transferred to the recording medium 30A, thereby fixing the toner image on the recording medium 30A.

The fixing device 26 may be, for example, a fuser known in itself, such as a hot-roll fuser or an oven fuser.

To be more specific, the fixing device 26 in an exemplary configuration may be a known fixing device that includes a fixing roller or fixing belt as the fixing member 26A and a pressure roller or pressure belt as the pressure member 26B.

The recording medium 30A has been transported along the transport route 34, passed through the region where the image carrier 12 and the transfer member 20 face each other (transfer region 32A), and thereby received the toner image transferred thereto. The recording medium 30A is then further transported along the transport route 34, for example by a transport member not illustrated, to the point where the fixing device 26 sits. At this point, the toner image on the recording medium 30A is fixed.

After an image is formed thereon through the fixation of the toner image, the recording medium 30A is ejected from the image forming apparatus 10 by multiple transport members not illustrated. The image carrier 12 from which static electricity has been removed by the static eraser 24 is charged again to a charging potential by the charging device 15.

Operation of the Image Forming Apparatus

The following describes an example of operations of an image forming apparatus 10 according to this exemplary embodiment. It should be noted that the operations of the image forming apparatus 10 are conducted by a control program that runs on the control device 36.

The image forming apparatus 10 forms an image as follows.

First, the surface of the image carrier 12 is charged by the charging device 15. The electrostatic charge image forming device 16 irradiates the charged surface of the image carrier 12 with light on the basis of image information, thereby forming an electrostatic charge image on the image carrier 12 in accordance with the image information. At the developing device 18, the electrostatic charge image formed on the surface of the image carrier 12 is developed with a developer that includes a specific toner for electrostatic charge image development. In this way, a toner image for electrostatic charge image development is formed on the surface of the image carrier 12.

At the transfer device 31, the toner image formed on the surface of the image carrier 12 is transferred to a recording medium 30A. The toner image transferred to the recording medium 30A is fixed by the fixing device 26.

The image carrier 12 from which the toner image has been transferred has its surface cleaned by the cleaning blade 220 of the cleaning device 22, and then static electricity is removed therefrom by the static eliminator 24.

Electrostatic Charge Image Developer

An electrostatic charge image developer according to this exemplary embodiment includes at least a specific toner. The electrostatic charge image developer according to this exemplary embodiment may be a one-component developer, which is substantially a specific toner, or may be a two-component developer, which is a mixture of a specific toner and a carrier.

Toner for Electrostatic Charge Image Development

A toner for electrostatic charge image development (specific toner) according to this exemplary embodiment includes toner particles and external additive(s).

Temperature and Viscosity Parameters of the Specific Toner

The specific toner satisfies the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)>(\ln \eta(T2)-\ln \eta(T3))/(T2-T3),$$

where η(T1) represents the viscosity of the specific toner at 60° C., η(T2) represents the viscosity of the specific toner at 90° C., and η(T3) represents the viscosity of the specific toner at 130° C.

The expression "ln η(T1)" herein represents the natural logarithm of the viscosity η of the toner at T1=60° C. It may be expressed as ln(η(T1)).

Viscosity values of a specific toner herein have a unit of Pa·s unless stated otherwise. These viscosity values at certain temperatures of a specific toner in this exemplary embodiment are measurements obtained as follows.

Loss moduli of a specific toner are determined by performing a temperature elevation test using a plate rheometer (Rheometrics RDA2, RHIOS system ver. 4.3). In the test, an approximately 0.3-g sample of the toner placed between 8-mm parallel plates is heated from approximately 30° C. to approximately 150° C. at a temperature elevation rate of 1° C./min under a 20% or less distortion at a frequency of 1 Hz.

The (ln η(T1)−ln η(T2))/(T1−T2) as a parameter of the specific toner is −0.14 or less. It may be −0.16 or less, preferably −0.30 or more and −0.18 or less, more preferably −0.25 or more and −0.20 or less in view of further reduction of both streak-shaped image defects and image deletion.

The (ln η(T2)−ln η(T3))/(T2−T3) as a parameter of the specific toner is −0.15 or more. It may be more than −0.14, preferably −0.13 or more, more preferably −0.12 or more and −0.03 or less, in particular −0.11 or more and −0.05 or less in view of further reduction of both streak-shaped image defects and image deletion.

Moreover, the (ln η(T2)−ln η(T3))/(T2−T3) of the specific toner is larger than the (ln η(T1)−ln η(T2))/(T1−T2) of the specific toner. The {(ln η(T2)−ln η(T3))/(T2−T3)}−{(ln η(T1)−ln η(T2))/(T1−T2)} may be 0.01 or more, preferably 0.05 or more and 0.5 or less, in particular 0.08 or more and 0.2 or less in view of further reduction of both streak-shaped image defects and image deletion.

The specific toner, moreover, may have a (ln η(T0)−ln η(T1))/(T0−T1), where η(T0) represents the viscosity η of the toner at T0=40° C., of −0.12 or more and greater than the (ln η(T1)−ln η(T2))/(T1−T2).

The specific toner becomes more effective in reducing both streak-shaped image defects and image deletion when it has a (ln η(T0)−ln η(T1))/(T0−T1) of −0.12 or more. The (ln η(T0)−ln η(T1))/(T0−T1) may be −0.05 or less, in particular −0.11 or more and −0.06 or less.

The specific toner, moreover, becomes more effective in reducing both streak-shaped image defects and image deletion when its (ln η(T0)−ln η(T1))/(T0−T1) is greater than its (ln η(T1)−ln η(T2))/(T1−T2). The {(ln η(T0)−ln η(T1))/(T0−T1)}−{(ln η(T1)−ln η(T2))/(T1−T2)} may be 0.01 or more, preferably 0.05 or more and 0.5 or less, in particular 0.08 or more and 0.2 or less.

It should be noted that these temperature and viscosity parameters ln η(T1)−ln η(T2))/(T1−T2), (ln η(T2)−ln η(T3))/(T2−T3), and (ln η(T0)−ln η(T1))/(T0−T1) of the toner may be controlled to be within the above ranges by any method. An example is to adjust the molecular weight of the binder resin in the toner particles, more specifically the molecular weights and percentages of the low-molecular-weight and high-molecular-weight components of the binder resin. If the toner particles are produced by the undermentioned aggregation and coalescence approach, these parameters may alternatively be controlled by adjusting the degree of aggregation, for example by changing the amount of flocculant.

The η(T0), η(T1), η(T2), and η(T3) of the specific toner, which are the viscosity values of the toner at T0=40° C., T1=60° C., T2=90° C., and T3=130° C., respectively, may be respectively within the following ranges in view of further reduction of both streak-shaped image defects and image deletion.

- η(T0): $1.0\times10^7$ or more and $1.0\times10^9$ or less (preferably $2.0\times10^7$ or more and $5.0\times10^8$ or less)
- η(T1): $1.0\times10^5$ or more and $1.0\times10^8$ or less (preferably $1.0\times10^6$ or more and $5.0\times10^7$ or less)
- η(T2): $1.0\times10^3$ or more and $1.0\times10^5$ or less (preferably $5.0\times10^3$ or more and $5.0\times10^4$ or less)
- η(T3): $1.0\times10^2$ or more and $1.0\times10^4$ or less (preferably $1.0\times10^2$ or more and $5.0\times10^3$ or less)

Highest-Endothermic-Peak Temperature of the Toner

The highest-endothermic-peak temperature of the specific toner may be 70° C. or more and 100° C. or less, preferably 75° C. or more and 95° C. or less, in particular 83° C. or more and 93° C. or less.

Here, the highest-endothermic-peak temperature of a specific toner is defined as the temperature at which the toner's differential scanning calorimetry (DSC) endothermic curve measured over the range of at least −30° C. to 150° C. has its highest peak.

A method that may be used to measure the highest-endothermic-peak temperature of a specific toner is as follows.

The measuring instrument is PerkinElmer DCS-7 differential scanning calorimeter. The temperature calibration of the colorimeter's detector is based on the melting point of indium and zinc, and the enthalpy calibration is based on the melting enthalpy of indium. An aluminum pan with a sample therein and a control empty pan are heated from room temperature to 150° C. at a temperature elevation rate of 10° C./min, cooled from 150° C. to −30° C. at a rate of 10° C./min, and then heated from −30° C. to 150° C. at a rate of 10° C./min. The temperature at which the largest endothermic peak is observed in the second run of heating is the highest-endothermic-peak temperature.

Infrared Absorption Spectrum of the Toner Particles

If the specific toner contains the undermentioned amorphous polyester resin as a binder resin, it may be that in an infrared absorption (IR) spectrum of the toner particles, the ratio of the absorbance at a wavenumber of 1,500 $cm^{-1}$ to that at 720 $cm^{-1}$ (absorbance at 1,500 $cm^{-1}$/absorbance at 720 $cm^{-1}$) is 0.6 or less, and, at the same time, the ratio of the absorbance at a wavenumber of 820 $cm^{-1}$ to that at 720 $cm^{-1}$ (absorbance at 820 $cm^{-1}$/absorbance at 720 $cm^{-1}$) is 0.4 or less in view of further reduction of both streak-shaped image defects and image deletion. Preferably, in an IR spectrum of the toner particles, the ratio of the absorbance at a wavenumber of 1,500 $cm^{-1}$ to that at 720 $cm^{-1}$ is 0.4 or less with the ratio of the absorbance at a wavenumber of 820 $cm^{-1}$ to that at 720 $cm^{-1}$ being 0.2 or less. It is more preferred that in an IR spectrum of the toner particles, the ratio of the absorbance at a wavenumber of 1,500 $cm^{-1}$ to that at 720 $cm^{-1}$ be 0.2 or more and 0.4 or less with the ratio of the absorbance at a wavenumber of 820 $cm^{-1}$ to that at 720 $cm^{-1}$ being 0.05 or more and 0.2 or less.

These IR absorbance values at certain wavenumbers in this exemplary embodiment are measured as follows. First, the toner particles of interest (after the removal of any external additive from the toner) are made into a sample for measurement by KBr tableting. This sample for measurement is analyzed using an IR spectrophotometer (JASCO FT-IR-410) at wavenumbers between 500 $cm^{-1}$ and 4,000 $cm^{-1}$ under the conditions of 300 scans and a resolution of 4 $cm^{-1}$. Then baseline correction is performed, for example in an offset, a spectral portion with no absorption, to determine the absorbance values at the wavenumbers.

The specific toner, moreover, may be such that in an IR spectrum of the toner particles, the ratio of the absorbance at a wavenumber of 1,500 $cm^{-1}$ to that at 720 $cm^{-1}$ may be 0.6 or less, preferably 0.4 or less, more preferably 0.2 or more and 0.4 or less, in particular 0.3 or more and 0.4 or less in view of further reduction of both streak-shaped image defects and image deletion.

Likewise, the specific toner may be such that in an IR spectrum of the toner particles, the ratio of the absorbance at a wavenumber of 820 $cm^{-1}$ to that at 720 $cm^{-1}$ may be 0.4 or less, preferably 0.2 or less, more preferably 0.05 or more and 0.2 or less, in particular 0.08 or more and 0.2 or less in view of further reduction of both streak-shaped image defects and image deletion.

Toner Particles

The toner particles contain, for example, a binder resin and optionally a coloring agent, a release agent, and/or other additives. Preferably, the toner particles contain a binder resin and a release agent.

In this exemplary embodiment, the toner particles may be of any kind. Examples include particles such as of a yellow, magenta, cyan, or black toner and even include white toner particles, transparent toner particles, and glossy toner particles.

Binder Resin

The binder resin may be, for example, a vinyl resin. The vinyl resin may be a homopolymer of a monomer or a copolymer of two or more monomers, and examples of monomers include styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Alternatively, the binder resin may be, for example, a non-vinyl resin, such as an epoxy resin, polyester resin, polyurethane resin, polyamide resin, cellulose resin, polyether resin, or modified rosin, a mixture of any of these resins and the aforementioned vinyl resin, or a graft copolymer obtained by copolymerizing a vinyl monomer in the presence of any of these non-vinyl resins.

One of these binder resins may be used alone, or two or more may be used in combination.

The binder resin(s) may include at least one selected from the group consisting of a styrene-acrylic resin and an amorphous polyester resin, preferably one of a styrene-acrylic resin and an amorphous polyester resin, in view of further reduction of both streak-shaped image defects and image deletion. It is more preferred that the percentage of the styrene-acrylic resin or amorphous polyester resin to the total mass of binder resins in the toner be 50% by mass or more, in particular 80% by mass or more.

A styrene-acrylic resin gives the specific toner strength and stability during storage if contained as a binder resin.

An amorphous polyester resin ensures fixation at low temperatures if contained in the specific toner as a binder resin.

The amorphous polyester resin may be one that has no bisphenol structure in view of further reduction of both streak-shaped image defects and image deletion and also of fixation.

(1) Styrene-Acrylic Resin

An example of a binder resin is a styrene-acrylic resin.

A styrene-acrylic resin is a copolymer of at least a styrene monomer (monomer having the styrene structure) and a (meth)acrylic monomer (monomer having a (meth)acrylic group, preferably a (meth)acryloxy group). Copolymers of, for example, a styrene monomer and any of the aforementioned (meth)acrylate monomers are also examples of styrene-acrylic resins.

It is to be noted that the acrylic resin segment of a styrene-acrylic resin is a moiety resulting from the polymerization of an acrylic monomer, a methacrylic monomer, or both. The expression "(meth)acrylic" is intended to represent both "acrylic" and "methacrylic."

Specific examples of styrene monomers include styrene, alkylated styrenes (e.g., α-methylstyrene, 2-methylstyrene, 3-methylstyrene, 4-methylstyrene, 2-ethylstyrene, 3-ethylstyrene, and 4-ethylstyrene), halogenated styrenes (e.g., 2-chlorostyrene, 3-chlorostyrene, and 4-chlorostyrene), and vinylnaphthalene. One styrene monomer may be used alone, or two or more may be used in combination.

Of these styrene monomers, styrene is preferred for its high reactivity, ready availability, and ease of control of the reaction involving it.

Specific examples of (meth)acrylic monomers include (meth)acrylic acid and (meth)acrylates. Examples of (meth) acrylates include alkyl (meth)acrylates (e.g., methyl (meth) acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate), aryl (meth)acrylates (e.g., phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamides. One (meth)acrylic monomer may be used alone, or two or more may be used in combination.

Of these (meth)acrylates as (meth)acrylic monomers, those (meth)acrylates that have a C2-14 (preferably C2-10, more preferably C3-8) alkyl group are preferred because they provide better fixation of the toner.

n-Butyl (meth)acrylate is particularly preferred. In particular, n-butyl acrylate is preferred.

The copolymer may contain styrene monomers and (meth)acrylic monomers in any ratio (by mass, styrene monomers/(meth)acrylic monomers). For example, the ratio of the two types of monomers in the copolymer may be between 85/15 to 70/30.

The styrene-acrylic resin may have a crosslink structure in view of further reduction of both streak-shaped image defects and image deletion. An example of a crosslinked styrene-acrylic resin is a copolymer of at least a styrene monomer, a (meth)acrylic monomer, and a crosslinking monomer.

The crosslinking monomer may be, for example, a crosslinking agent that has two or more functional groups.

Examples of bifunctional crosslinking agents include divinyl benzene, divinyl naphthalene, di(meth)acrylate compounds (e.g., diethylene glycol di(meth)acrylate, methylene bis(meth)acrylamide, decanediol diacrylate, and glycidyl (meth)acrylate), polyester-forming di(meth)acrylates, and 2-([1'-methylpropylideneamino]carboxyamino)ethyl methacrylate.

Examples of multifunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., pentaerythritol tetra(meth)acrylate and oligoester (meth)acrylates), 2,2-bis(4-methacryloxy, polyethoxyphenyl)propane, diallyl phthalate, triallyl cyanurate, triallyl isocyanurate, triallyl trimellitate, and diaryl chlorendate.

Preferably, the crosslinking monomer is a (meth)acrylate compound that has two or more functional groups in view of further reduction of both streak-shaped image defects and image deletion and also of fixation. It is more preferred that the crosslinking agent be a bifunctional (meth)acrylate compound, even more preferably a bifunctional (meth)acrylate that has a C6-20 alkylene group, in particular a bifunctional (meth)acrylate that has a linear C6-20 alkylene group.

The copolymer may contain crosslinking monomers in any ratio to all monomers (by mass, crosslinking monomers/all monomers). For example, the ratio of crosslinking monomers to all monomers may be between 2/1,000 and 20/1,000.

The glass transition temperature (Tg) of the styrene-acrylic resin may be 40° C. or more and 75° C. or less, preferably 50° C. or more and 65° C. or less, in view of fixation.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121-1987 "Testing Methods for Transition Temperatures of Plastics."

The weight-average molecular weight of the styrene-acrylic resin may be 5,000 or more and 200,000 or less, preferably 10,000 or more and 100,000 or less, in particular 20,000 or more and 80,000 or less, in view of stability during storage.

The production of the styrene-acrylic resin may be by any method. A wide variety of polymerization techniques (solution polymerization, precipitation polymerization, suspension polymerization, bulk polymerization, emulsion polymerization, etc.) may be used, and the polymerization reactions may be done by any process (batch, semicontinuous, continuous, etc.).

(2) Polyester Resin

A polyester resin is also an example of a binder resin.

The polyester resin may be, for example, a known amorphous polyester resin. It is also possible to use a crystalline polyester resin in combination with an amorphous polyester resin. In that case, the percentage of the crystalline polyester resin may be, for example, 2% by mass or more and 40% by mass or less (preferably 2% by mass or more and 20% by mass or less) with respect to all binder resins.

If a resin is "crystalline" herein, it means that the resin exhibits not stepwise changes in heat absorption but a clear endothermic peak when analyzed by differential scanning calorimetry (DSC). To be more specific, being "crystalline" herein means that the half width of the endothermic peak as measured at a temperature elevation rate of 10 (° C./min) is 10° C. or narrower.

Meanwhile, if a resin is "amorphous" herein, it means that in DSC, the above half width is broader than 10° C., the resin exhibits stepwise changes in heat absorption, or the endothermic peak is not clear.

Amorphous Polyester Resin

The amorphous polyester resin may be, for example, a polycondensate of a polycarboxylic acid and a polyhydric alcohol. The amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of these acids. Of these polycarboxylic acids, aromatic dicarboxylic acids, for example, are preferred.

The polycarboxylic acids, it is also possible to use a dicarboxylic acid in combination for a crosslinked or branched, have three or more carboxylic groups. Examples of carboxylic acids that have three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these polyhydric alcohols, aromatic diols and alicyclic diols, for example, are preferred, and aromatic diols are more preferred.

The polyhydric alcohols, it is also possible to use a diol in combination for a crosslinked or branched, have three or more hydroxyl groups. Examples of polyhydric alcohols that have three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is that determined from the resin's DSC curve, which is obtained by differential scanning calorimetry (DSC). More specifically, this glass transition temperature is the resin's "extrapolated initial temperature of glass transition" as in the methods for determining glass transition temperatures set forth in JIS K 7121-1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution Mw/Mn of the amorphous polyester resin may be 1.5 or more and 100 or less, preferably 2 or more and 60 or less.

These weight- and number-average molecular weights are those measured by gel permeation chromatography (GPC). By GPC, the resin is analyzed using HLC-8120GPC, a GPC system from Tosoh, and Tosoh TSKgel SuperHM-M column (15 cm) with the eluate tetrahydrofuran (THF). Comparing the measured data with a molecular-weight calibration curve prepared using monodisperse polystyrene standards gives the weight- and number-average molecular weights.

The production of the amorphous polyester resin may be by a known method. To be more specific, the amorphous polyester resin may be obtained by, for example, polymerizing starting monomers by condensation polymerization at a temperature of 180° C. or more and 230° C. or less, optionally under reduced pressure so that the water and alcohol as condensation by-products will be removed.

If the starting monomers do not dissolve or are not compatible with each other at the reaction temperature, a high-boiling-point solvent as a solubilizer may be added to help them dissolve. In that case, the solubilizer is removed by distillation during the polycondensation. If the copolymerization involves a monomer that is incompatible with the reaction system, this monomer may be first condensed with an acid or alcohol planned to participate in the polycondensation and then subjected to polycondensation with the remaining ingredient(s).

Crystalline Polyester Resin

The crystalline polyester resin may be, for example, a polycondensate of a polycarboxylic acid and a polyhydric alcohol. The crystalline polyester resin may be a commercially available one or may be a synthesized one.

The crystalline polyester resin may be a polycondensate made using polymerizable monomers having a linear aliphatic structure, rather than an aromatic structure. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of these acids.

The polycarboxylic acids, it is also possible to use a dicarboxylic acid in combination for a crosslinked or branched, have three or more carboxylic groups. Examples of carboxylic acids that have three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of these acids.

Moreover, it is possible to use any of the above carboxylic acids with a dicarboxylic acid that has a sulfonic acid group and/or a dicarboxylic acid that has an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these aliphatic diols, 1,8-octanediol, 1,9-nonanediol, and 1,10-decanediol are preferred.

The polyhydric alcohols, it is also possible to use a diol in combination for a crosslinked or branched, have three or more hydroxyl groups. Examples of alcohols that have three or more hydroxyl groups include glycerol, trimethylolethane, trimethylolpropane, and pentaerythritol.

One polyhydric alcohol may be used alone, or two or more may be used in combination.

For polyhydric alcohols, the percentage of aliphatic diols may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the resin's "peak melting temperature" as in the methods for determining melting temperatures set forth in JIS K7121-1987 "Testing Methods for Transition Temperatures of Plastics" and is determined from the resin's DSC curve, which is obtained by differential scanning calorimetry (DSC).

The weight-average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The amount of the binder resin(s) may be, for example, 40% by mass or more and 95% by mass or less, preferably 50% by mass or more and 90% by mass or less, more preferably 60% by mass or more and 85% by mass or less of the total mass of the toner particles.

If the toner particles are white toner particles, the percentage of the binder resin(s) may be 30% by mass or more and 85% by mass or less, preferably 40% by mass or more and 60% by mass or less of the total mass of the white toner particles.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, malachite green oxalate, titanium oxide, zinc oxide, calcium carbonate, basic lead carbonate, a zinc sulfide-barium sulfate mixture, zinc sulfide, silicon dioxide, and aluminum oxide, and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

If the toner particles are white toner particles, the coloring agent is a white pigment.

The white pigment may be titanium oxide or zinc oxide, preferably titanium oxide.

If the toner particles are white toner particles, the amount of the white pigment may be 15% by mass or more and 70% by mass or less, preferably 20% by mass or more and 60% by mass or less, of the total mass of the white toner particles.

One coloring agent may be used alone, or two or more may be used in combination.

The coloring agent(s) may optionally be surface-treated one(s) and may be used in combination with a dispersant. Moreover, multiple coloring agents may be used in combination.

The amount of the coloring agent(s) may be 1% by mass or more and 30% by mass or less, preferably 3% by mass or more and 15% by mass or less of the total mass of the toner particles.

Release Agent

Examples of release agents include, but are not limited to, hydrocarbon waxes; natural waxes, such as carnauba wax, rice wax, and candelilla wax; synthesized or mineral/petroleum waxes, such as montan wax; and ester waxes, such as fatty acid esters and montanates.

The melting temperature of the release agent may be 50° C. or more and 110° C. or less, preferably 70° C. or more and 100° C. or less, more preferably 75° C. or more and 95° C. or less, in particular 83° C. or more and 93° C. or less, in view of further reduction of both streak-shaped image defects and image deletion and also of fixation.

This melting temperature is the agent's "peak melting temperature" as in the methods for determining melting temperatures set forth in JIS K 7121-1987 "Testing Methods for Transition Temperatures of Plastics" and is determined from the agent's DSC curve, which is obtained by differential scanning calorimetry (DSC).

The toner particles in the specific toner may satisfy the relation $1.0<a/b<8.0$, where a and b are the numbers of the release agent with an aspect ratio of 5 or more and smaller than 5, respectively, in the toner particles, in view of further reduction of both streak-shaped image defects and image deletion and also of fixation. Preferably, the toner particles satisfy the relation $2.0<a/b<7.0$, in particular $3.0<a/b<6.0$.

The toner particles in the specific toner, moreover, may satisfy the relation $1.0<c/d<4.0$, where c and d are the areas of the release agent with an aspect ratio of 5 or more and smaller than 5, respectively, in the toner particles, in view of further reduction of both streak-shaped image defects and image deletion and also of fixation. Preferably, the toner particles satisfy the relation $1.5<c/d<3.5$, in particular $2.0<c/d<3.0$.

The measurement of the aspect ratio of the release agent in the toner particles is as follows.

The toner is mixed into an epoxy resin, and the epoxy resin is solidified. The resulting solid is sliced using an ultramicrotome (Leica Ultracut UCT) to give a thin section with a thickness of 80 nm or more and 130 nm or less as a sample. The thin-section sample is stained with ruthenium tetroxide for 3 hours in a desiccator at 30° C. The stained thin-section sample is imaged by scanning electron microscopy (SEM) using an ultrahigh-resolution field-emission scanning electron microscope (FE-SEM) (e.g., S-4800 from Hitachi High-Technologies Corp.). Release agents are generally stained more heavily than binder resins with ruthenium tetroxide, so the release agent is identified by shades of color caused by the degree of staining. If it is difficult to distinguish between the shades, for example because of the condition of the sample, the duration of staining is adjusted. Size may also provide the basis for identifying the release agent. In a cross-section of a toner particle, the coloring-agent domain is usually smaller than the release-agent domain.

The SEM image includes cross-sections of toner particles of various sizes. From these cross-sections, those having a diameter of 85% or more of the volume-average diameter of the toner particles are selected, and 100 of them are randomly selected and observed. Here, the diameter of a cross-section of a toner particle is defined as the longest distance between any two points on the outline of the cross-section (so-called major axis).

Each of the 100 cross-sections of toner particles selected in the SEM image is analyzed using image analysis software (WinROOF from Mitani Corp.) under the condition of 0.010000 μm/pixel. The image analysis visualizes the cross-sections of toner particles by displaying the embedding epoxy resin and the binder resin(s) in the toner particles with different levels of brightness (with a contrast therebetween). On the visualized image, the major axis and the aforementioned ratio (major axis/minor axis) and area of the release-agent domains in the toner particles can be determined.

The adjustment of the aspect ratio of the release agent in the toner particles may be done by several methods. For example, the toner may be maintained near the freezing point of the release agent for a certain period of time during cooling so that crystal growth will take place, or two or more release agents with different melting temperatures may be used to accelerate crystal growth during cooling.

The amount of the release agent(s) may be, for example, 1% by mass or more and 20% by mass or less, preferably 5% by mass or more and 15% by mass or less of the total mass of the toner particles.

Other Additives

Examples of other additives include magnetic substances, charge control agents, inorganic powders, and other known additives. These additives, if used, are contained in the toner particles as internal additives.

Characteristics and Other Details of the Toner Particles

The toner particles may be single-layer toner particles or may be so-called core-shell toner particles, i.e., toner particles formed by a core section (core particle) and a coating layer that covers the core section (shell layer).

The core-shell toner particles may be formed by, for example, a core section that includes a binder resin and optionally additives, such as a coloring agent and/or a release agent, and a coating layer that includes a binder resin.

The volume-average diameter (D50v) of the toner particles may be 2 μm or more and 10 μm or less, preferably 4 μm or more and 8 μm or less.

The volume-average diameter of the toner particles is that measured using a Coulter Multisizer II (Beckman Coulter) and an ISOTON-II electrolyte (Beckman Coulter).

The measurement is as follows. A sample for measurement weighing 0.5 mg or more and 50 mg or less is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

With the sample suspended therein, the electrolyte is sonicated for 1 minute using a sonicator. The resulting dispersion is analyzed using Coulter Multisizer II with an aperture size of 100 μm to determine the particle size distribution of those particles that are 2 μm or more and 60 μm or less across. The number of particles sampled is 50000.

The determined particle size distribution is divided into segments by particle size (channels), and the cumulative distribution of volume is plotted starting from the smallest diameter. The particle diameter at which the cumulative volume is 50% is defined as the volume-average diameter D50v.

The toner particles may have any average roundness. In view of easier cleaning of the toner off the image carrier, however, the average roundness may be 0.91 or more and 0.98 or less, preferably 0.94 or more and 0.98 or less, more preferably 0.95 or more and 0.97 or less.

The average roundness of the toner particles is given by (circumference of the equivalent circle)/(circumference) [(circumference of circles having the same projected area as the particle images)/(circumference of the projected images of the particles)]. A specific way of determining it is as follows.

First, a number of the toner particles of interest are sampled by aspiration. By photographing the resulting flat stream with a flash, the figures of the particles therein are captured in a still image. Then the particle images are analyzed using a flow particle-image analyzer (Sysmex FPIA-3000) to determine the average roundness. The number of particles sampled in the determination of the average roundness is 3500.

If the toner contains an external additive, the toner (developer) of interest is dispersed in water containing a surfactant and sonicated. This gives toner particles isolated from the external additive.

The average roundness of the toner particles may be controlled by several methods. For example, if the toner particles are produced by aggregation and coalescence, the average roundness may be controlled by adjusting the speed of stirring of the liquid dispersion, temperature of the liquid dispersion, or time for which the liquid dispersion is maintained during fusion and coalescence.

External Additive(s)

An example of an external additive is inorganic particles. Examples of such inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles as an external additive may be hydrophobic as a result of treatment. An example of a hydrophobic treatment is to immerse the inorganic particles in an agent for hydrophobic treatment. Any kind of agent may be used, but examples include silane coupling agents, silicone oil, titanate coupling agents, and aluminum coupling agents. One of these may be used alone, or two or more may be used in combination.

The amount of the agent(s) for hydrophobic treatment is usually 1 part by mass or more and 10 parts by mass or less, for example, per 100 parts by mass of the inorganic particles.

Substances such as resin particles (particles of polystyrene, polymethyl methacrylate (PMMA), melamine resins, etc.) and active cleaning agents (e.g., metal salts of higher fatty acids, typically zinc stearate, and particles of fluoropolymers) are also examples of external additives.

The amount of the external additive(s) may be, for example, 0.01% by mass or more and 10% by mass or less, preferably 0.01% by mass or more and 6% by mass or less, of the toner particles.

Production of the Toner

Next is described a method for producing the specific toner.

The specific toner is obtained by producing toner particles and then adding external additive(s) to the toner particles.

The production of the toner particles may be by a dry process (e.g., kneading and milling) or a wet process (e.g., aggregation and coalescence, suspension polymerization, or dissolution and suspension). Besides these, any known process may be used to produce the toner particles.

Preferably, the toner particles are obtained by aggregation and coalescence.

If the toner particles are produced by aggregation and coalescence, an example of a specific procedure includes:

preparing a resin-particle dispersion as a liquid dispersion in which resin particles to serve as a binder resin are dispersed (preparation of a resin-particle dispersion); making the resin particles (and optionally other kind(s) of particles) aggregate in the resin-particle dispersion (or a liquid dispersion prepared by mixing with other liquid dispersion(s) of particles) to form aggregates (formation of aggregates); heating the liquid dispersion in which the aggregates are dispersed, or aggregate dispersion, to make the aggregates fuse and coalesce together, thereby forming toner particles (fusion and coalescence).

The following describes the details of each operation.

It should be noted that the method described below gives toner particles that include a coloring agent and a release agent, but the coloring agent and the release agent are optional. Naturally, additives other than a coloring agent and a release agent may also be used.

Preparation of a Resin-Particle Dispersion

First, a liquid dispersion in which resin particles to serve as a binder resin are dispersed (resin-particle dispersion) is prepared. In addition to this, a liquid dispersion in which particles of a coloring agent are dispersed (coloring-agent-particle dispersion) and a liquid dispersion in which particles of a release agent are dispersed (release-agent-particle dispersion), for example, are prepared.

The preparation of the resin-particle dispersion is by, for example, dispersing the resin particles in a dispersion medium using a surfactant.

The dispersion medium for the resin-particle dispersion may be, for example, an aqueous medium.

Examples of aqueous media include kinds of water, such as distilled water and ion exchange water, and alcohols. One of these may be used alone, or two or more may be used in combination.

The surfactant may be, for example, an anionic surfactant, such as a sulfate surfactant, sulfonate surfactant, phosphate surfactant, or soap surfactant; a cationic surfactant, such as an amine or quaternary ammonium surfactant; or a nonionic surfactant, such as a polyethylene glycol, alkylphenol ethylene oxide, or polyhydric alcohol surfactant, in particular an anionic or cationic surfactant. Nonionic surfactants, if used, may be used in combination with an anionic or cationic surfactant.

One surfactant may be used alone, or two or more may be used in combination.

In preparing the resin-particle dispersion, the process of dispersing the resin particles in the dispersion medium may be done by a commonly used dispersion technique, such as a rotary-shear homogenizer or a ball mill, sand mill, Dyno-Mill, or other medium mill. For certain types of resin particles, phase inversion emulsification, for example, may be used to disperse the resin particles in the resin-particle dispersion.

Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to convert the resin from W/O to O/W (so-called phase inversion), creating a discontinuous phase and thereby dispersing particles of the resin in the aqueous medium.

The volume-average diameter of the resin particles to be dispersed in the resin-particle dispersion may be, for example, 0.01 μm or more and 1 μm or less, preferably 0.08 μm or more and 0.8 μm or less, more preferably 0.1 μm or more and 0.6 μm or less.

This volume-average diameter of the resin particles is the volume-average particle diameter D50v determined as follows. The particles are analyzed using a laser-diffraction particle size analyzer (e.g., HORIBA LA-700). The measured particle size distribution is divided into segments by particle size (channels). The cumulative distribution of volume is plotted starting from the smallest diameter. The particle diameter at which the cumulative volume is 50% of that of all particles is the volume-average particle diameter D50v. For the other dispersions, too, the volume-average diameter of the particles therein is that determined by the same method.

The amount of the resin particles in the resin-particle dispersion may be, for example, 5% by mass or more and 50% by mass or less, preferably 10% by mass or more and 40% by mass or less.

The preparation of the coloring-agent-particle and release-agent-particle dispersions, for example, is similar to that of the resin-particle dispersion. The above discussion on the volume-average particle diameter, dispersion medium, method of dispersion, and amount for the particles in the resin-particle dispersion therefore also applies to the coloring-agent particles dispersed in the coloring-agent-particle dispersion and the release-agent particles dispersed in the release-agent-particle dispersion.

Formation of Aggregates

Then, the resin-particle dispersion is mixed with the coloring-agent-particle and release-agent-particle dispersions.

In the mixture of dispersions, the resin particles, the coloring-agent particles, and the release-agent particles are caused to aggregate together. Through this process of heteroaggregation, aggregates that include resin, coloring-agent, and release-agent particles are formed to a diameter close to the planned diameter of the toner particles.

A specific example of a procedure is as follows. A flocculant is added to the dispersion mixture, and the pH of the mixture is adjusted to an acidic level (e.g., a pH of 2 or more and 5 or less). At this point, a dispersion stabilizer may optionally be added. The dispersion mixture is then heated to a temperature close to the glass transition temperature of the resin particles (specifically, for example, a temperature higher than or equal to the resin particles' glass transition temperature minus 30° C. but not higher than the resin particles' glass transition temperature minus 10° C.) to make the particles dispersed in the mixture aggregate together, forming aggregates.

In an exemplary configuration of the formation of aggregates, the dispersion mixture may be stirred using a rotary-shear homogenizer, and the flocculant may be added at room temperature (e.g., 25° C.) while the mixture is stirred. Then the pH of the mixture is adjusted to an acidic level (e.g., a pH of 2 or more and 5 or less) and then, optionally with a dispersion stabilizer therein, heated as described above.

The flocculant may be, for example, a surfactant that has the opposite polarity to that used as a dispersant in the dispersion mixture, an inorganic metal salt, or a metal complex having a valency of 2 or more. The use of a metal complex as a flocculant improves charging characteristics by reducing the amount of surfactants used.

An additive that forms a complex or similar linkage with metal ions of the flocculant may optionally be used. This additive may be a chelating agent.

Examples of inorganic metal salts include metal salts such as calcium chloride, calcium nitrate, barium chloride, magnesium chloride, zinc chloride, aluminum chloride, and aluminum sulfate, and polymers of inorganic metal salts, such as polyaluminum chloride, polyaluminum hydroxide, and calcium polysulfide.

The chelating agent may be a water-soluble one. Examples of chelating agents include oxycarboxylic acids, such as tartaric acid, citric acid, and gluconic acid, iminodiacetic acid (IDA), nitrilotriacetic acid (NTA), and ethylenediaminetetraacetic acid (EDTA).

The amount of the chelating agent may be, for example, 0.01 parts by mass or more and 5.0 parts by mass or less, preferably 0.1 parts by mass or more and less than 3.0 parts by mass, per 100 parts by mass of resin particles.

Fusion and Coalescence

The aggregates are then caused to fuse and coalesce together and thereby to form toner particles, for example by heating the liquid dispersion in which the aggregates are dispersed, or aggregate dispersion, to at least the resin particles' glass transition temperature (e.g., to 10° C. to 30° C. higher than the resin particles' glass transition temperature or a higher temperature).

The fusion and coalescence of the aggregates into toner particles may alternatively be achieved by heating the aggregate dispersion to at least the melting temperature of the release agent. In the process of fusion and coalescence, the resin and release agent fuse together at a temperature that is higher than or equal to the glass transition temperature of the resin particles and higher than or equal to the melting temperature of the release agent. The heated aggregate dispersion is then cooled to give toner.

The adjustment of the aspect ratio of the release agent in the toner particles may be done by several methods. For example, the toner may be maintained near the freezing point of the release agent for a certain period of time during cooling so that crystal growth will take place, or two or more release agents with different melting temperatures may be used to accelerate crystal growth during cooling.

Through these operations, the toner particles are obtained.

Alternatively, the toner particles may be produced as follows. After the preparation of the liquid dispersion in which aggregates are dispersed (aggregate dispersion), this aggregate dispersion is mixed with another liquid dispersion in which resin particles are dispersed (resin-particle dispersion), and the resin particles and the aggregates are caused to aggregate together in such a manner that the resin particles adhere to the surface of the aggregates. This gives second aggregates. The resulting liquid dispersion in which the second aggregates are dispersed, or second-aggregate dispersion, is heated to make the second aggregates fuse and coalesce and thereby form core/shell toner particles.

After the end of fusion and coalescence, the toner particles, formed in a solution, are subjected to known operations of washing, solid-liquid separation, and drying to give dry toner particles.

The washing may be by replacement with plenty of ion exchange water in view of ease of charging. The solid-liquid separation may be by any method, but techniques such as suction filtration and pressure filtration may be used in view of productivity. The drying, too, may be by any method, but techniques such as lyophilization, flash drying, fluidized drying, and vibrating fluidized drying may be used in view of productivity.

The specific toner is then produced, for example by mixing the resulting dry toner particles with external additive(s). The mixing may be performed using, for example, a V-blender, Henschel mixer, or Lödige mixer. The toner may optionally be sieved, for example through a vibrating sieve or air-jet sieve, to remove coarse particles.

Carrier

Any type of carrier may be used, and examples include known carriers. The carrier may be, for example, a coated carrier, which is formed by covering the surface of a core magnetic powder with a coating resin; a magnetic powder-dispersed carrier, formed by dispersing and mixing a magnetic powder in a matrix resin; or a resin-impregnated carrier, formed by impregnating a porous magnetic powder with a resin.

A magnetic powder-dispersed or resin-impregnated carrier may be one formed by the constituting particles as a core and a coating resin covering this core.

Examples of magnetic powders include powders of magnetic metals, such as iron, nickel, and cobalt, and magnetic oxides, such as ferrite and magnetite.

For the coating and matrix resins, examples include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins, which include organosiloxane bonds, or their modified forms, fluoropolymers, polyester, polycarbonate, phenolic resins, and epoxy resins.

The coating and matrix resins may contain additives, such as conductive particles.

Examples of conductive particles include particles of gold, silver, copper, or any other metal, carbon black, titanium oxide, zinc oxide, tin oxide, barium sulfate, aluminum borate, and potassium titanate.

The covering of the surface of the core with a coating resin may be by, for example, covering the surface of the core using a solution of the coating resin and optionally additives in a solvent (solution for coating layer formation). The solvent may be of any kind and is selected in consideration of, for example, the coating resin used and suitability for application.

Specific examples of methods of resin coating include dipping, which means immersing the core in the solution for coating layer formation, spraying, which means spraying the solution for coating layer formation onto the surface of the core, the fluidized bed method, in which the core is caused to float on flowing air and sprayed with the solution for coating layer formation in that state, and the kneader-coater method, in which mixing of the core for the carrier with the solution for coating layer formation and removal of the solvent are performed in a kneader-coater.

For a two-component developer, the mixing ratio (by mass) between the toner and the carrier may be between 1:100 and 30:100 (toner for electrostatic charge image development:carrier), preferably between 3:100 and 20:100.

EXAMPLES

The following describes examples of an exemplary embodiment of the present disclosure, but the exemplary embodiment of the present disclosure is not limited to these examples. In the following description, all "parts" and "%" are by mass unless stated otherwise. The viscosity, highest-endothermic-peak temperature, and absorbances at selected wavelengths of the toners for electrostatic charge image development are measured as described above.

The viscosity, highest-endothermic-peak temperature, and absorbances at selected wavelengths of the toners are measured as described above.

Developers A1 to A13 and B1 to B3

Preparation of Liquid Dispersions of Styrene-Acrylic Resin Particles

Production of Resin-Particle Dispersion (1)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 2 parts a liquid mixture of the above raw materials is emulsified, the emulsified liquid is added to the flask over 120 minutes, and emulsification polymerization is continued for another 4 hours. This gives a resin-particle dispersion as a liquid dispersion of resin particles having a weight-average molecular weight of 32,000, a glass transition temperature of 53° C., and a volume-average diameter of 240 nm. To this resin-particle dispersion, ion exchange water is added to adjust the solids content to 20% by mass. The resulting dispersion is resin-particle dispersion (1). Production of Resin-Particle Dispersion (2)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 6 parts of ammonium persulfate in 50 parts of ion exchange water is added. The system is then purged with plenty of nitrogen and heated in an oil bath until the temperature inside reaches 75° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 2.5 parts a liquid mixture of the above raw materials is emulsified, the emulsified liquid is added to the flask over 120 minutes, and emulsification polymerization is continued for another 4 hours. This gives a resin-particle dispersion as a liquid dispersion of resin particles having a weight-average molecular weight of 30,000, a glass transition temperature of 53° C., and a volume-average diameter of 220 nm. To this resin-particle dispersion, ion exchange water is added to adjust the solids content to 20% by mass. The resulting dispersion is resin-particle dispersion (2).

Production of Resin-Particle Dispersion (3)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 7 parts of ammonium persulfate in 50 parts of ion exchange water is added. The system is then purged with plenty of nitrogen and heated in an oil bath until the temperature inside reaches 80° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 3.0 parts a liquid mixture of the above raw materials is emulsified, the emulsified liquid is added to the flask over 120 minutes, and emulsification polymerization is continued for another 4 hours. This gives a resin-particle dispersion as a liquid dispersion of resin particles having a weight-average molecular weight of 28,000, a glass transition temperature of 53° C., and a volume-average diameter of 230 nm. To this resin-particle dispersion, ion exchange water is added to adjust the solids content to 20% by mass. The resulting dispersion is resin-particle dispersion (3).

Production of Resin-Particle Dispersion (4)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 2.0 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 7.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 3.5 parts a liquid mixture of the above raw materials is emulsified, the emulsified liquid is added to the flask over 120 minutes, and emulsification polymerization is continued for another 4 hours. This gives a resin-particle dispersion as a liquid dispersion of resin particles having a weight-average molecular weight of 26,500, a glass transition temperature of 53° C., and a volume-average diameter of 210 nm. To this resin-particle dispersion, ion exchange water is added to adjust the solids content to 20% by mass. The resulting dispersion is resin-particle dispersion (4).

Production of Resin-Particle Dispersion (5)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 0.8 parts A solution of 4 parts of an anionic surfactant (Dowfax, Dow Chemical) in 550 parts of ion exchange water is put into a flask, and a liquid mixture of the above raw materials is added to cause emulsification. While the emulsified liquid is stirred slowly for 10 minutes, a solution of 5.5 parts of ammonium persulfate in 50 parts of ion exchange water is added. The system is then purged with plenty of nitrogen and heated in an oil bath until the temperature inside reaches 85° C., and polymerization is allowed to proceed for 30 minutes.

Then,

Styrene: 110 parts
n-Butyl acrylate: 50 parts
β-Carboxyethyl acrylate: 5 parts
1,10-Decanediol diacrylate: 2.5 parts
Dodecanethiol: 1.7 parts a liquid mixture of the above raw materials is emulsified, the emulsified liquid is added to the flask over 120 minutes, and emulsification polymerization is continued for another 4 hours. This gives a resin-particle dispersion as a liquid dispersion of resin particles having a weight-average molecular weight of 36,000, a glass transition temperature of 53° C., and a volume-average diameter of 260 nm. To this resin-particle dispersion, ion exchange water is added to adjust the solids content to 20% by mass. The resulting dispersion is resin-particle dispersion (5).

Preparation of Liquid Dispersion of Magenta-Colored Particles

C.I. Pigment Red 122: 50 parts
Ionic surfactant Neogen RK (DKS Co., Ltd.): 5 parts
Ion exchange water: 220 parts These ingredients are mixed together, and the resulting mixture is processed using an Ultimaizer (Sugino Machine Ltd.) for 10 minutes at 240 MPa to give a liquid dispersion of magenta-colored particles (solids concentration: 20%).

Preparation of Release-Agent-Particle Dispersion (1)

Ester wax (WEP-2, NOF Corp.): 100 parts
Anionic surfactant (Neogen RK, DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (Gaulin). This gives release-agent-particle dispersion (1) as a liquid dispersion of release-agent particles having a volume-average diameter of 330 nm (solids content, 29.1%).

Preparation of Release-Agent-Particle Dispersion (2)

Fischer-Tropsch wax (HNP-9, Nippon Seiro Co., Ltd.): 100 parts
Anionic surfactant (Neogen RK, DKS Co., Ltd.): 2.5 parts
Ion exchange water: 250 parts These materials are mixed together and heated to 120° C. After dispersion using a homogenizer (IKA ULTRA-TURRAX T50), the mixture is subjected to further dispersion using a Manton-Gaulin high-pressure homogenizer (Gaulin). This gives release-agent-particle dispersion (2) as a liquid dispersion of release-agent particles having a volume-average diameter of 340 nm (solids content, 29.2%).

Preparation of Release-Agent-Particle Dispersion (3)

Paraffin wax (FNP0090, Nippon Seiro Co., Ltd.): 100 parts

Anionic surfactant (Neogen RK, DKS Co., Ltd.): 2.5 parts

Ion exchange water: 250 parts

These materials are mixed together and heated to 120° C. After dispersion using a homogenizer (IKA ULTRA-TURRAX T50), the mixture is subjected to further dispersion using a Manton-Gaulin high-pressure homogenizer (Gaulin). This gives release-agent-particle dispersion (3) as a liquid dispersion of release-agent particles having a volume-average diameter of 360 nm (solids content, 29.0%).

Preparation of Release-Agent-Particle Dispersion (4)

Polyethylene wax (Polywax 725, Toyo ADL Corp.): 100 parts

Anionic surfactant (Neogen RK, DKS Co., Ltd.): 2.5 parts

Ion exchange water: 250 parts

These materials are mixed together and heated to 100° C. After dispersion using a homogenizer (IKA ULTRA-TURRAX T50), the mixture is subjected to further dispersion using a Manton-Gaulin high-pressure homogenizer (Gaulin). This gives release-agent-particle dispersion (4) as a liquid dispersion of release-agent particles having a volume-average diameter of 370 nm (solids content, 29.3%).

Process for the Production of Toner A1

Ion exchange water: 400 parts

Resin-particle dispersion (1): 200 parts

Liquid dispersion of magenta-colored particles: 40 parts

Release-agent-particle dispersion (2): 12 parts

Release-agent-particle dispersion (3): 24 parts

These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, IKA Japan K.K.), a PAC aqueous solution, prepared by dissolving 2.1 parts of polyaluminum chloride (PAC, Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 5.0 μm. Then another 115 parts of resin-particle dispersion (1) is added to attach resin particles (shell structure) to the surface of the aggregates.

Then 20 parts of a 10% by mass aqueous solution of a NTA (nitrilotriacetic acid) metal salt (CHELEST 70, Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, Nippon Aerosil Co., Ltd.) and 1.0 part of hydrophobic titanium oxide (T805, Nippon Aerosil Co., Ltd.) for 30 seconds at 10,000 rpm using a sample mill. The mixture is then sieved through a 45-μm-mesh vibrating sieve. The resulting material is toner A1 (toner A1 for electrostatic charge image development). The volume-average particle diameter of toner A1 is 5.7 μm.

Production of Developer A1

Eight parts of toner A1 and 92 parts of a carrier are mixed using a V-blender. The resulting mixture is developer A1 (electrostatic charge image developer A1).

Production of Developers A2 to A13 and B1 and B2

Magenta toners A2 to A13 and B1 and B2 are each obtained in the same way as toner A1 except that parameter changes are made as in Table 1 regarding the resin-particle dispersion, the release-agent-particle dispersions, the amount of flocculant, the temperature at which coalescence is performed, the temperature at which the toner slurry is maintained, and the duration for which the toner slurry is maintained at that temperature.

Then electrostatic charge image developers A2 to A13 and B1 and B2 are each produced in the same way as developer A1 except that the respective toners are used.

Production of Developer B3

Magenta toner B3 is obtained in the same way as toner A1 except that parameter changes are made as in Table 1 regarding the resin-particle dispersion, the release-agent-particle dispersions, the amount of flocculant, the temperature at which coalescence is performed, the temperature at which the toner slurry is maintained, and the duration for which the toner slurry is maintained at that temperature.

Then electrostatic charge image developer B3 is produced in the same way as developer A1 except that the resulting toner is used.

TABLE 1

| Toner | Inη(T1)-Inη(T2))/(T1-T2) | (Inη(T2)-Inη(T3))/(T2-T3) | (Inη(T0)-Inη(T1))/(T0-T1) | (Inη(T2)-Inη(T3))/(T2-T3)-(Inη(T1)-Inη(T2))/(T1-T2) | (Inη(T0)-Inη(T1))/(T0-T1)-(Inη(T1)-Inη(T2))/(T1-T2) | Toner's highest-endo-thermic-peak temperature (° C.) | a/b | c/d |
|---|---|---|---|---|---|---|---|---|
| A1 | −0.215 | −0.090 | −0.110 | 0.125 | 0.105 | 85 | 5.0 | 2.9 |
| A2 | −0.168 | −0.080 | −0.085 | 0.088 | 0.083 | 85 | 5.1 | 2.5 |
| A3 | −0.143 | −0.100 | −0.078 | 0.043 | 0.065 | 85 | 4.9 | 2.6 |
| A4 | −0.213 | −0.090 | −0.106 | 0.123 | 0.107 | 85 | 5.0 | 2.8 |
| A5 | −0.214 | −0.100 | −0.100 | 0.114 | 0.104 | 85 | 5.1 | 2.4 |
| A6 | −0.154 | −0.135 | −0.077 | 0.019 | 0.077 | 70 | 5.1 | 2.6 |
| A7 | −0.153 | −0.133 | −0.080 | 0.020 | 0.073 | 100 | 4.9 | 2.8 |
| A8 | −0.155 | −0.141 | −0.083 | 0.014 | 0.072 | 63 | 5.0 | 2.5 |
| A9 | −0.156 | −0.136 | −0.079 | 0.020 | 0.077 | 102 | 5.1 | 2.9 |
| A10 | −0.152 | −0.141 | −0.073 | 0.011 | 0.079 | 85 | 1.5 | 1.3 |

TABLE 1-continued

| | | | | | | | |
|---|---|---|---|---|---|---|---|
| A11 | −0.153 | −0.142 | −0.071 | 0.011 | 0.082 | 85 | 7.2 | 3.5 |
| A12 | −0.155 | −0.135 | −0.075 | 0.020 | 0.080 | 85 | 8.5 | 4.5 |
| A13 | −0.154 | −0.134 | −0.078 | 0.020 | 0.076 | 85 | 0.7 | 0.6 |
| B1 | −0.129 | −0.090 | −0.068 | 0.039 | 0.061 | 85 | 5.3 | 2.9 |
| B2 | −0.215 | −0.155 | −0.113 | 0.060 | 0.102 | 85 | 5.3 | 2.9 |
| B3 | −0.180 | −0.186 | −0.109 | −0.006 | 0.071 | 85 | 5.3 | 2.9 |

| | | First release-agent-particle dispersion | | Second release-agent-particle dispersion | | Toner production parameters | | | |
|---|---|---|---|---|---|---|---|---|---|
| Toner | Resin-particle dispersion | Type | Parts | Type | Parts | Amount of flocculant (parts) | Coalescence temperature (° C.) | Maintenance temperature (° C.) | Duration of maintenance (hours) |
| A1 | (3) | (2) | 12 | (3) | 24 | 2.1 | 91 | 85 | 1 |
| A2 | (2) | (2) | 12 | (3) | 24 | 2.1 | 92 | 85 | 1 |
| A3 | (1) | (2) | 12 | (3) | 24 | 2.1 | 93 | 85 | 1 |
| A4 | (3) | (2) | 12 | (3) | 24 | 1.9 | 92 | 85 | 1 |
| A5 | (3) | (2) | 12 | (3) | 24 | 1.7 | 91 | 85 | 1 |
| A6 | (1) | (1) | 12 | (2) | 24 | 1.7 | 77 | 70 | 1 |
| A7 | (1) | (3) | 12 | (4) | 24 | 1.7 | 108 | 95 | 1 |
| A8 | (1) | (1) | 28.8 | (2) | 7.2 | 1.7 | 70 | 65 | 1 |
| A9 | (1) | (3) | 7.2 | (4) | 28.8 | 1.7 | 108 | 95 | 1 |
| A10 | (1) | (2) | 12 | (3) | 24 | 1.7 | 91 | 85 | 0.5 |
| A11 | (1) | (2) | 12 | (3) | 24 | 1.7 | 92 | 85 | 2 |
| A12 | (1) | (2) | 12 | (3) | 24 | 1.7 | 93 | 85 | 3 |
| A13 | (1) | (2) | 12 | (3) | 24 | 1.7 | 92 | 85 | 0.25 |
| B1 | (5) | (2) | 12 | (3) | 24 | 2.1 | 91 | 85 | 1 |
| B2 | (3) | (2) | 12 | (3) | 24 | 1.5 | 93 | 85 | 1 |
| B3 | (4) | (2) | 12 | (3) | 24 | 2.1 | 93 | 85 | 1 |

Production of Image carrier A1

Formation of an Undercoat Layer

One hundred parts by mass of zinc oxide (average particle diameter, 70 nm; manufactured by Tayca Corporation; specific surface area, 15 $m^2/g$) is mixed with 500 parts by mass of toluene by stirring, 1.3 parts by mass of a silane coupling agent (KBM503, manufactured by Shin-Etsu Chemical) is added, and the resulting mixture is stirred for 2 hours. The toluene is removed by distillation under reduced pressure, and the residue is baked at 120° C. for 3 hours to give a zinc oxide surface-treated with the silane coupling agent. Then 110 parts by mass of the surface-treated zinc oxide is mixed with 500 parts by mass of tetrahydrofuran by stirring, a solution of 0.6 parts by mass of alizarin in 50 parts by mass of tetrahydrofuran is added, and the resulting mixture is stirred at 50° C. for 5 hours. The alizarin-attached zinc oxide is isolated by filtration under reduced pressure and then dried at 60° C. under reduced pressure to give alizarin-attached zinc oxide.

Sixty parts by mass of the alizarin-attached zinc oxide, 13.5 parts by mass of a curing agent (blocked isocyanate, SUMIDUE 3175, manufactured by Sumitomo Bayern Urethane), and 15 parts by mass of a butyral resin (S-LEC BM-1, manufactured by Sekisui Chemical) are mixed into 85 parts by mass of methyl ethyl ketone, 38 parts by mass of the resulting liquid is mixed with 25 parts by mass of methyl ethyl ketone, and the resulting mixture is subjected to 2 hours of dispersion with 1-mm glass beads in a sand mill to give a liquid dispersion. To the liquid dispersion, 0.005 parts by mass of dioctyltin dilaurate as a catalyst and 40 parts by mass of particles of a silicone resin (TOSPEARL 145, manufactured by Momentive Performance Materials) are added. The resulting liquid is a liquid for undercoat layer formation. The liquid for undercoat layer formation is applied to an aluminum substrate by dip coating, and the resulting coating is dried and cured at 170° C. for 40 minutes to give a 20-μm thick undercoat layer.

Formation of a Charge-Generating Layer

A mixture of 15 parts by mass of a charge-generating material (CGM-1), 10 parts by mass of a vinyl chloride-vinyl acetate copolymer resin (VMCH, manufactured by Nippon Unicar) as a binder resin, and 200 parts by mass of n-butyl acetate is subjected to 4 hours of dispersion with 1-mm glass beads in a sand mill. The charge-generating material is a hydroxygallium phthalocyanine whose x-ray diffraction spectrum measured using characteristic x-rays of Cukα has diffraction peaks at Bragg angles (2θ±0.2°) of at least 7.3°, 16.0°, 24.9°, and 28.0°. The resulting liquid dispersion is stirred with 175 parts by mass of n-butyl acetate and 180 parts by mass of methyl ethyl ketone. The resulting liquid is a liquid for charge-generating layer formation. The liquid for charge-generating layer formation is applied to the undercoat layer by dip coating, and the resulting coating is dried at room temperature (25° C.) to give a 0.2-μm thick charge-generating layer.

Formation of a Charge-Transport Layer

To 100 parts by mass of untreated (hydrophilic) silica particles "trade name, OX50 (manufactured by NIPPON AEROSIL CO., LTD.); volume-average diameter, 40 nm," 30 parts of a trimethylsilane compound (1,1,1,3,3,3-hexamethyldisilazane (manufactured by Tokyo Chemical Industry)) as an agent for hydrophobic treatment is added. After 24 hours of reaction, the product is collected by filtration. The resulting hydrophobic silica particles are silica particles (1). The percentage condensation of silica particles (1) is 93%.

Then 250 parts by mass of tetrahydrofuran is added to 50 parts by mass of silica particles (1), and the resulting mixture is mixed with 25 parts by mass of 4-(2,2-diphenylethyl)-4', 4"-dimethyl-triphenylamine as a charge-transport material and 25 parts by mass of a bisphenol-Z polycarbonate resin (viscosity-average molecular weight: 30000) as a binder resin by stirring for 12 hours with the liquid's temperature kept at 20° C. The resulting liquid is a liquid for charge-transport layer formation.

The liquid for charge-transport layer formation is applied to the charge-generating layer. The resulting coating is dried at 135° C. for 40 minutes to give a 30-μm thick charge-transport layer.

Formation of a Surface-Protecting Layer

Then 30 parts by mass of compound (A-4) below, which is a charge-transport material, 0.2 parts by mass of colloidal silica (trade name, PL-1; Fuso Chemical), 30 parts by mass of toluene, 0.1 parts by mass of 3,5-di-t-butyl-4-hydroxytoluene (BHT), 0.1 parts by mass of azoisobutyronitrile (10-hour half-life temperature: 65° C.), and V-30 (FUJIFILM Wako Pure Chemical Corporation; 10-hour half-life temperature, 104° C.) are combined. The resulting liquid is a liquid for surface-protecting layer formation. This liquid is applied to the charge-transport layer by spray coating, and the resulting coating is air-dried at room temperature (25° C.) for 30 minutes, then heated from room temperature to 150° C. over 30 minutes at an oxygen concentration of 110 ppm, and then further heated at 150° C. for 30 minutes to cure, giving a 10-μm thick surface-protecting layer. The resulting image carrier is image carrier A1.

image carrier (angle of contact) is 11°, and the pressure N with which the cleaning blade is pressed against the image carrier is set to 2.5 gf/mm$^2$.

Testing

The image forming apparatuses of each Example or Comparative Example are tested for streak-shaped image defects, image deletion, and the amount of supply of the lubricant.

Test for Streak-Shaped Image Defects

The image forming apparatuses of each Example or Comparative Example are operated to form an image on A4-size paper (210×297 mm, Fuji Xerox P paper) until 100K cumulative cycles of rotation (100,000 rotations) of the image carrier under high-temperature and high-humidity conditions (28° C. and 85%). Then an image with an area coverage of 1% is printed until a pv of 5000 (pv=print volume, the number of sheets on which the image is formed), and a full-size 30% halftone image is printed on one sheet of the same recording medium thereafter. The printed image is graded for streak-shaped image defects in accordance with the following criteria.

(A-4)

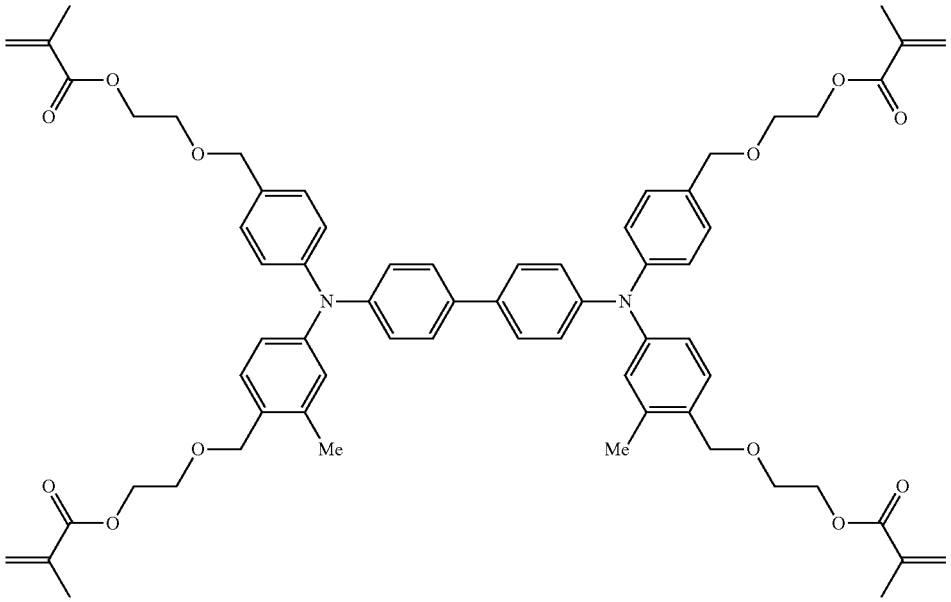

Preparation of the Lubricant and Lubricant Supplying Member A1

A plate of zinc stearate is used as a lubricant (solid lubricant). A rotary brush made of Belltron 10D is used as lubricant supplying member A1.

Production of Cleaning Blade A1

A polyurethane plate having a hardness of 75 degrees and measuring 347 mm×10 mm×2 mm (thickness) is used as a cleaning blade.

Examples 1 to 13 and Comparative Examples 1 to 3

A modified COLOR 10000 PRESS (manufactured by Fuji Xerox) is prepared as an image forming apparatus. The developer specified in Table 2 is loaded, and image carrier A1 as an image carrier, the lubricant, lubricant supplying member A1, and cleaning blade A1 as a cleaning blade are attached. The angle θ between the cleaning blade and the Criteria for grading:

A: No white streaks in terms of image quality.

B: The color density is not even throughout the image, but the difference is very minor and acceptable.

C: The color density is not even throughout the image, but the difference is acceptable.

D: A clear and unacceptable streak-shaped image defect is observed.

Test for Image Deletion

The image forming apparatuses of each Example or Comparative Example are operated to print a halftone image with an image density of 50% continuously on 10000 sheets under high-temperature and high-humidity conditions (28° C. and 85%). Each image forming apparatus is then left under high-temperature and high-humidity conditions (28° C. and 80% RH) for 24 hours, and a full-size halftone image with a 30% density is printed on the same recording medium thereafter. The quality of the printed image is assessed visually in accordance with the following criteria.

A: No image deletion.

B: Image deletion is observed but poses no image quality issue.

C: Some degree of image deletion is observed.

D: Image deletion poses an image quality issue.

Test for the Amount of Supply of the Lubricant

For the image forming apparatuses of each Example or Comparative Example, the supply of the lubricant per unit area of the image carrier (μg/cm$^2$) is determined as described hereinabove. The results are presented in Table 2.

TABLE 2

| | | Developer | Testing: Streak-shaped image defects | Image deletion | Lubricant supply per unit area of the image carrier [μg/cm$^2$] |
|---|---|---|---|---|---|
| Examples | 1 | A1 | A | B | 0.05 |
| | 2 | A2 | A | A | 1.1 |
| | 3 | A3 | A | A | 1.4 |
| | 4 | A4 | A | B | 0.3 |
| | 5 | A5 | A | B | 0.05 |
| | 6 | A6 | A | A | 1.4 |
| | 7 | A7 | A | A | 1.3 |
| | 8 | A8 | A | A | 1.2 |
| | 9 | A9 | A | A | 1.3 |
| | 10 | A10 | A | A | 1.5 |
| | 11 | A11 | B | A | 1.6 |
| | 12 | A12 | B | A | 1.6 |
| | 13 | A13 | A | A | 1.5 |
| Comparative Examples | 1 | B1 | D | B | 1.9 |
| | 2 | B2 | A | C | 0.04 |
| | 3 | B3 | D | A | 1.9 |

As can be seen from the table, the image forming apparatuses of Examples reduce both streak-shaped image defects and image deletion in comparison with those of Comparative Examples.

Developers A101 to A113 and B101 to B103

Preparation of Liquid Dispersions of Amorphous Polyester Resin Particles

Production of Resin-Particle Dispersion (101)

To a dried three-neck flask are added 60 parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide. In a nitrogen atmosphere, the reaction is allowed to proceed for 3 hours at 185° C. while the water resulting from the reaction is removed out of the system. Then the temperature is increased to 240° C. while the pressure is reduced gradually. After another 4 hours of reaction, the system is cooled. The product is amorphous polyester resin (101) and has a weight-average molecular weight of 39,000.

After the removal of any precipitate, 200 parts of amorphous polyester resin (101) is added to a separable flask together with 100 parts of methyl ethyl ketone, 35 parts of isopropyl alcohol, and 7.0 parts of a 10% by mass aqueous solution of ammonia. The materials are mixed thoroughly to dissolve the resin, and then ion exchange water is added dropwise using a delivery pump at a rate of 8 g/min while the solution is heated and stirred at 40° C. After the solution becomes uniformly turbid, the delivery of ion exchange water is continued at an increased rate of 15 g/min to induce phase inversion and terminated after 580 parts of water has been added. Then the solvents are removed under reduced pressure. The resulting liquid is liquid dispersion (101) of amorphous polyester resin particles (resin-particle dispersion (101)). The volume-average diameter and solids concentration of the resulting polyester resin particles are 170 nm and 35%, respectively.

Preparation of Resin-Particle Dispersions (102) to (105)

Resin-particle dispersions (102) to (105) are obtained in the same way as resin-particle dispersion (101) except that the polymerization is performed under the conditions specified in Table 3.

TABLE 3

| | Resin's durations of polymerization | Polyester resin's weight-average molecular weight |
|---|---|---|
| Dispersion (101) of amorphous polyester resin particles | 3 hours at 185° C., 4 hours at 240° C. | 39,000 |
| Dispersion (102) of amorphous polyester resin particles | 2.5 hours at 185° C., 3.5 hours at 240° C. | 37,000 |
| Dispersion (103) of amorphous polyester resin particles | 2 hours at 185° C., 3 hours at 240° C. | 35,000 |
| Dispersion (104) of amorphous polyester resin particles | 1.5 hours at 185° C., 2.5 hours at 240° C. | 33,000 |
| Dispersion (105) of amorphous polyester resin particles | 4 hours at 185° C., 5 hours at 240° C. | 43,000 |

Process for the Production of Toner A101

Ion exchange water: 400 parts

Liquid dispersion (101) of amorphous polyester resin particles: 200 parts

Liquid dispersion of magenta-colored particles: 40 parts

Release-agent-particle dispersion (2): 12 parts

Release-agent-particle dispersion (3): 24 parts

These ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater.

While the ingredients are dispersed using a homogenizer (ULTRA-TURRAX T50, IKA Japan K.K.), a PAC aqueous solution, prepared by dissolving 2.1 parts of polyaluminum chloride (PAC, Oji Paper Co., Ltd.; 30% powder) in 100 parts of ion exchange water, is added. Then the temperature is increased to 50° C., and the particle diameter is measured using a Coulter Multisizer II (aperture size, 50 μm; Coulter) to ensure that the volume-average particle diameter is 4.9 μm. Then another 115 parts of liquid dispersion (101) of amorphous polyester resin particles is added to attach resin particles (shell structure) to the surface of the aggregates.

Then 20 parts of a 10% by mass aqueous solution of a NTA (nitrilotriacetic acid) metal salt (CHELEST 70, Chelest Corp.) is added, and the pH is adjusted to 9.0 with a 1 N aqueous solution of sodium hydroxide. Then the temperature is increased to 91° C. at an elevation rate of 0.05° C./min and maintained at 91° C. for 3 hours, and the resulting toner slurry is cooled to 85° C. and maintained for 1 hour and then cooled to 25° C. The resulting magenta toner is washed by repeated dispersion in ion exchange water and filtration until the filtrate's electrical conductivity is 20 μS/cm or less. The washed toner is vacuum-dried for 5 hours in an oven at 40° C. to give toner particles.

One hundred parts of the toner particles is mixed with 1.5 parts of hydrophobic silica (RY50, Nippon Aerosil Co., Ltd.) and 1.0 part of hydrophobic titanium oxide (T805, Nippon Aerosil Co., Ltd.) for 30 seconds at 10,000 rpm using a sample mill. The mixture is then sieved through a 45-μm-mesh vibrating sieve. The resulting material is toner A101 (toner A101 for electrostatic charge image development). The volume-average particle diameter of toner A101 is 5.8 μm.

Production of Developer A101

Eight parts of toner A101 and 92 parts of a carrier are mixed using a V-blender. The resulting mixture is developer A101 (electrostatic charge image developer A101).

Production of Developers A102 to A113 and B101 and B102

Magenta toners A102 to A113 and B101 and B102 are each obtained in the same way as toner A101 except that parameter changes are made as in Table 4 regarding the resin-particle dispersion, the release-agent-particle dispersions, the amount of flocculant, the temperature at which coalescence is performed, the temperature at which the toner slurry is maintained, and the duration for which the toner slurry is maintained at that temperature.

Then electrostatic charge image developers A102 to A113 and B101 and B102 are each produced in the same way as developer A101 except that the respective toners are used.

Production of Developer B103

Magenta toner B103 is obtained in the same way as toner A101 except that parameter changes are made as in Table 4 regarding the resin-particle dispersion, the release-agent-particle dispersions, the amount of flocculant, the temperature at which coalescence is performed, the temperature at which the toner slurry is maintained, and the duration for which the toner slurry is maintained at that temperature.

Then electrostatic charge image developer B103 is produced in the same way as developer A101 except that the resulting toner is used.

TABLE 4

| Toner | Inη(T1)-Inη(T2))/(T1-T2) | (Inη(T2)-Inη(T3))/(T2-T3) | (Inη(T0)-Inη(T1))/(T0-T1) | (Inη(T2)-Inη(T3))/(T2-T3)-(Inη(T1)-Inη(T2))/(T1-T2) | (Inη(T0)-Inη(T1))/(T0-T1)-(Inη(T1)-Inη(T2))/(T1-T2) | Toner's highest-endo-thermic-peak temperature (° C.) | a/b | c/d | 1,500 $cm^{-1}$/720 $cm^{-1}$ |
|---|---|---|---|---|---|---|---|---|---|
| A101 | −0.220 | −0.110 | −0.100 | 0.110 | 0.120 | 85 | 5.2 | 2.7 | 0.30 |
| A102 | −0.163 | −0.070 | −0.080 | 0.093 | 0.083 | 85 | 4.9 | 2.3 | 0.31 |
| A103 | −0.141 | −0.100 | −0.065 | 0.041 | 0.076 | 85 | 4.8 | 2.7 | 0.29 |
| A104 | −0.222 | −0.080 | −0.111 | 0.142 | 0.111 | 85 | 5.2 | 2.7 | 0.33 |
| A105 | −0.211 | −0.110 | −0.101 | 0.101 | 0.110 | 85 | 5.0 | 2.5 | 0.34 |
| A106 | −0.156 | −0.131 | −0.075 | 0.025 | 0.081 | 70 | 4.9 | 2.4 | 0.30 |
| A107 | −0.154 | −0.135 | −0.072 | 0.019 | 0.082 | 100 | 4.7 | 2.9 | 0.29 |
| A108 | −0.155 | −0.139 | −0.079 | 0.016 | 0.076 | 85 | 1.6 | 1.4 | 0.33 |
| A109 | −0.154 | −0.141 | −0.077 | 0.013 | 0.077 | 85 | 7.1 | 3.3 | 0.29 |
| A110 | −0.151 | −0.136 | −0.072 | 0.015 | 0.079 | 63 | 5.2 | 2.9 | 0.27 |
| A111 | −0.153 | −0.140 | −0.081 | 0.013 | 0.072 | 102 | 5.1 | 2.5 | 0.34 |
| A112 | −0.152 | −0.133 | −0.080 | 0.019 | 0.072 | 85 | 8.6 | 4.6 | 0.33 |
| A113 | −0.151 | −0.133 | −0.071 | 0.018 | 0.080 | 85 | 0.8 | 0.5 | 0.31 |
| B101 | −0.127 | −0.110 | −0.055 | 0.017 | 0.072 | 85 | 5.0 | 2.7 | 0.34 |
| B102 | −0.221 | −0.160 | −0.132 | 0.061 | 0.089 | 85 | 5.1 | 2.8 | 0.28 |
| B103 | −0.203 | −0.224 | −0.119 | −0.021 | 0.084 | 85 | 5.3 | 3.0 | 0.36 |

| Toner | 820 $cm^{-1}$/720 $cm^{-1}$ | Resin-particle dispersion | First release-agent-particle dispersion | | Second release-agent-particle dispersion | | Amount of flocculant (parts) | Toner production parameters | | |
|---|---|---|---|---|---|---|---|---|---|---|
| | | | Type | Parts | Type | Parts | | Coalescence temperature (° C.) | Maintenance temperature (° C.) | Duration of maintenance (hours) |
| A101 | 0.16 | (103) | (2) | 12 | (3) | 24 | 2.1 | 91 | 85 | 1 |
| A102 | 0.15 | (102) | (2) | 12 | (3) | 24 | 2.1 | 92 | 85 | 1 |
| A103 | 0.17 | (101) | (2) | 12 | (3) | 24 | 2.1 | 93 | 85 | 1 |
| A104 | 0.16 | (103) | (2) | 12 | (3) | 24 | 1.9 | 92 | 85 | 1 |
| A105 | 0.17 | (103) | (2) | 12 | (3) | 24 | 1.7 | 91 | 85 | 1 |
| A106 | 0.16 | (101) | (1) | 12 | (2) | 24 | 1.7 | 77 | 70 | 1 |
| A107 | 0.15 | (101) | (3) | 12 | (4) | 24 | 1.7 | 108 | 95 | 1 |
| A108 | 0.17 | (101) | (2) | 12 | (3) | 24 | 1.7 | 91 | 85 | 0.5 |
| A109 | 0.18 | (101) | (2) | 12 | (3) | 24 | 1.7 | 92 | 85 | 2 |
| A110 | 0.16 | (103) | (1) | 28.8 | (2) | 7.2 | 1.7 | 70 | 65 | 1 |
| A111 | 0.17 | (103) | (3) | 7.2 | (4) | 28.8 | 1.7 | 108 | 95 | 1 |
| A112 | 0.16 | (103) | (2) | 12 | (3) | 24 | 1.7 | 93 | 85 | 3 |
| A113 | 0.15 | (103) | (2) | 12 | (3) | 24 | 1.7 | 92 | 85 | 0.25 |
| B101 | 0.16 | (105) | (2) | 12 | (3) | 24 | 2.1 | 91 | 85 | 1 |
| B102 | 0.18 | (103) | (2) | 12 | (3) | 24 | 1.5 | 93 | 85 | 1 |
| B103 | 0.17 | (104) | (2) | 12 | (3) | 24 | 1.5 | 93 | 85 | 1 |

Examples 101 to 113 and Comparative Examples 101 to 103

A modified COLOR 10000 PRESS (manufactured by Fuji Xerox) is prepared as an image forming apparatus. The developer specified in Table 5 is loaded, and image carrier A1 as an image carrier, the lubricant, lubricant supply member A1, and cleaning blade A1 as a cleaning blade are attached. The angle θ between the cleaning blade and the image carrier (angle of contact) is 11°, and the pressure N with which the cleaning blade is pressed against the image carrier is set to 2.5 gf/mm$^2$.

Testing

The image forming apparatuses of each Example or Comparative Example are tested for streak-shaped image defects, image deletion, and the amount of supply of the lubricant in the same way as above.

TABLE 5

| | | | Testing | | |
|---|---|---|---|---|---|
| | | Developer | Streak-shaped image defects | Image deletion | Lubricant supply per unit area of the image carrier [μg/cm$^2$] |
| Examples | 101 | A101 | A | B | 0.1 |
| | 102 | A102 | A | A | 1.3 |
| | 103 | A103 | B | A | 1.8 |
| | 104 | A104 | A | B | 0.05 |
| | 105 | A105 | A | B | 0.1 |
| | 106 | A106 | A | A | 1.4 |
| | 107 | A107 | B | A | 1.6 |
| | 108 | A108 | A | A | 1.3 |
| | 109 | A109 | A | A | 1.2 |
| | 110 | A110 | B | A | 1.6 |
| | 111 | A111 | A | A | 1.2 |
| | 112 | A112 | A | A | 1.2 |
| | 113 | A113 | B | A | 1.6 |
| Comparative Examples | 101 | B101 | D | B | 1.9 |
| | 102 | B102 | A | C | 0.04 |
| | 103 | B103 | D | A | 1.9 |

In the above tables, "a/b" is "a/b where a and b are the numbers of the release agents with an aspect ratio of 5 or more and smaller than 5, respectively, in the toner," "c/d" is "c/d where c and d are the areas of the release agents with an aspect ratio of 5 or more and smaller than 5, respectively, in the toner," "1,500 cm$^{-1}$/720 cm$^{-1}$" is the ratio of the absorbance at a wavelength of 1,500 cm$^{-1}$ to that at 720 cm$^{-1}$ in an infrared absorption spectrum of the toner particles of the toner, and "820 cm$^{-1}$/720 cm$^{-1}$" is the ratio of the absorbance at a wavelength of 820 cm$^{-1}$ to that at 720 cm$^{-1}$ in an infrared absorption spectrum of the toner particles of the toner.

As can be seen from the table, the image forming apparatuses of Examples reduce both streak-shaped image defects and image deletion in comparison with those of Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier;

a charging section that charges a surface of the image carrier;

an electrostatic charge image forming section that forms an electrostatic charge image on the charged surface of the image carrier;

a developing section that has a container containing an electrostatic charge image developer and develops the electrostatic charge image formed on the surface of the image carrier into a toner image using the electrostatic charge image developer, the electrostatic charge image developer including toner containing toner particles and an external additive;

a transfer section that transfers the toner image formed on the surface of the image carrier to a surface of a recording medium;

a cleaning section that has a cleaning blade with which the cleaning section cleans the surface of the image carrier; and a lubricant supplying section that has a lubricant supplying member that supplies a lubricant to a contact portion between the cleaning blade and the image carrier, the toner t satisfying the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) represents a viscosity of the toner at 60° C., η(T2) represents a viscosity of the toner at 90° C., and η(T3) represents a viscosity of the toner at 130° C., wherein the toner has a highest-endothermic-peak temperature between 70° C. and 100° C.

2. The image forming apparatus according to claim 1, wherein the toner has a (ln η(T0)−ln η(T1))/(T0−T1), where η(T0) is a viscosity η of the toner at T0=40° C., of −0.12 or more, and the (ln η(T0)−ln η(T1))/(T0−T1) is greater than the (ln η(T1)−ln η(T2))/(T1−T2).

3. The image forming apparatus according to claim 1, wherein the toner satisfies the following relation:

$$(\ln \eta(T1)-\ln \eta(T2))/(T1-T2)\leq -0.16.$$

4. The image forming apparatus according to claim 1, wherein the toner satisfies the following relation:

$$(\ln \eta(T2)-\ln \eta(T3))/(T2-T3)\geq -0.13.$$

5. The image forming apparatus according to claim 1, wherein:

the toner contains a release agent; and the following relation is satisfied:

$$1.0<c/d<4.0$$

where c and d are areas of the release agent with an aspect ratio of 5 or more and smaller than 5, respectively, in the toner.

6. The image forming apparatus according to claim 1, wherein the toner has a highest-endothermic-peak temperature between 75° C. and 95° C.

7. The image forming apparatus according to claim 1, wherein the toner contains a styrene-acrylic resin as a binder resin.

8. The image forming apparatus according to claim 1, wherein the toner contains an amorphous polyester resin as a binder resin.

9. The image forming apparatus according to claim 1, wherein the lubricant supplying member is a rotary brush.

10. The image forming apparatus according to claim 9, wherein the lubricant supplying section is one that applies the lubricant to the rotary brush and supplies the applied lubricant to the surface of the image carrier.

11. The image forming apparatus according to claim 1, wherein the lubricant contains at least one fatty acid metal salt.

12. The image forming apparatus according to claim 11, wherein the fatty acid metal salt includes zinc stearate.

13. An image forming apparatus comprising:

an image carrier;

a charging section that charges a surface of the image carrier;

an electrostatic charge image forming section that forms an electrostatic charge image on the charged surface of the image carrier;

a developing section that has a container containing an electrostatic charge image developer and develops the electrostatic charge image formed on the surface of the image carrier into a toner image using the electrostatic charge image developer, the electrostatic charge image developer including toner containing toner particles and an external additive;

a transfer section that transfers the toner image formed on the surface of the image carrier to a surface of a recording medium;

a cleaning section that has a cleaning blade with which the cleaning section cleans the surface of the image carrier; and a lubricant supplying section that has a lubricant supplying member that supplies a lubricant to a contact portion between the cleaning blade and the image carrier, the toner t satisfying the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) represents a viscosity of the toner at 60° C., η(T2) represents a viscosity of the toner at 90° C., and η(T3) represents a viscosity of the toner at 130° C., wherein:

the toner contains a release agent; and the following relation is satisfied:

$$1.0<a/b<8.0$$

where a and b are numbers of the release agent with an aspect ratio of 5 or more and smaller than 5, respectively, in the toner.

14. A process cartridge that is attached to and detached from an image forming apparatus, the process cartridge comprising:

a developing section that contains an electrostatic charge image developer and develops an electrostatic charge image formed on a surface of an image carrier into a toner image using the electrostatic charge image developer, the electrostatic charge image developer including toner for electrostatic charge image development, the toner containing toner particles and an external additive;

a cleaning section that has a cleaning blade with which the cleaning section cleans the surface of the image carrier; and a lubricant supplying section that has a lubricant supplying member that supplies a lubricant to a contact portion between the cleaning blade and the image carrier, the toner satisfying the following relations:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) represents a viscosity of the toner at 60° C., η(T2) represents a viscosity of the toner at 90° C., and η(T3) represents a viscosity of the toner at 130° C., wherein the toner has a highest-endothermic-peak temperature between 70° C. and 100° C.

* * * * *